US006245277B1

(12) United States Patent
Diamond

(10) Patent No.: US 6,245,277 B1
(45) Date of Patent: Jun. 12, 2001

(54) INJECTION MOLD ASSEMBLY FOR MOLDING PLASTIC CONTAINERS

(75) Inventor: David W. Diamond, Dudley, MA (US)

(73) Assignee: John Clementi, Princeton, MA (US)

( * ) Notice: Subject to any disclaimer, the term of this patent is extended or adjusted under 35 U.S.C. 154(b) by 0 days.

(21) Appl. No.: 09/318,588

(22) Filed: May 25, 1999

Related U.S. Application Data

(63) Continuation-in-part of application No. 09/281,367, filed on Mar. 30, 1999.

(51) Int. Cl.[7] ..... B29C 45/43

(52) U.S. Cl. ..... 264/328.1; 264/334; 264/335; 425/556; 425/437; 425/438; 425/444; 425/DIG. 58

(58) Field of Search ..... 264/328.1, 334, 264/335, 336, 318; 425/511, DIG. 58, 556, 437, 438, 444

(56) References Cited

U.S. PATENT DOCUMENTS

| | | | | |
|---|---|---|---|---|
| 3,977,563 | | 8/1976 | Holt . | |
| 4,125,246 | * | 11/1978 | Von Holdt | 425/556 |
| 4,286,766 | | 9/1981 | von Holdt . | |
| 4,293,080 | | 10/1981 | Letica . | |
| 4,349,119 | | 9/1982 | Letica . | |
| 4,383,819 | | 5/1983 | Letica . | |
| 4,397,404 | | 8/1983 | Blanchette . | |
| 4,491,238 | * | 1/1985 | Tobolt . | |
| 4,512,494 | | 4/1985 | von Holdt . | |
| 4,524,882 | * | 6/1985 | Buc . | |
| 4,619,373 | | 10/1986 | Galer . | |
| 4,648,834 | * | 3/1987 | Von Holdt | 425/556 |
| 4,777,004 | | 10/1988 | Galer . | |
| 5,097,977 | | 3/1992 | Straub . | |
| 5,476,187 | * | 12/1995 | Marisco . | |
| 5,536,161 | * | 7/1996 | Smith | 425/556 |
| 5,932,164 | * | 8/1999 | Allen | 264/328.1 |

* cited by examiner

*Primary Examiner*—Jill L. Heitbrink
(74) *Attorney, Agent, or Firm*—Pandiscio & Pandiscio

(57) ABSTRACT

A mold assembly is provided for injection molding a plastic container that is adapted to releasably interlock with a lid for sealing off the container. The mold assembly is arranged to mold a container that is characterized by a rim section that projects inwardly of the inner surface of the container's side wall and has an annular locking channel for receiving a locking rib on the lid. The mold assembly comprises a core member, a first cavity member that cooperates with the core member to form a first mold cavity section that is shaped to mold the bottom and side walls of the container, and a second cavity member that cooperates with the core member and the first cavity member to form a second mold cavity section that is an extension of said first mold cavity section and is shaped to mold the rim section of the container.

31 Claims, 17 Drawing Sheets

INJECTION MOLD ASSEMBLY FOR MOLDING PLASTIC CONTAINERS

This application is a continuation-in-part of copending application Ser. No. 09/281,367, filed Mar. 30, 1999.

The present invention relates generally to manufacture of plastic containers for containing paint or other materials, and more particularly to a new apparatus and method for injection molding plastic containers that are adapted to be sealed off by removable lids.

FIELD OF THE INVENTION

As is well known, the ordinary one-gallon paint can has been made of steel and is provided with a friction fit lid that also is made of steel. In the paint industry prevention of leakage is important since paint cans frequently encounter rough handling while being transported or stacked for storage or retail display. Consequently a substantially hermetic seal is required between the paint can and its lid. This is achieved by a friction fit air-tight engagement between the lid and container which is such as to permit the lid to be removed manually using a suitable prying tool. In addition, the standard metal paint can lid does not protrude beyond the perimeter of the paint can so that as to prevent accidental disengagement of the lid. The configuration of the interlocking connection between the standard metal paint cans and their metal lids is such that the lids remain tightly in place even when subjected to the action of paint shaking machines or to other severe handling or shock conditions. Further the lids can be re-attached to again provide a fluid tight seal with the container. However standard metal paint cans have certain shortcomings, one of which is the tendency to corrode.

In the past, efforts have been made to provide containers for paint that are made of plastic. For example, U.S. Pat. No. 5,097,977, issued Mar. 24, 1992 to R. Straub illustrates a closure assembly for a container that comprises a snap ring connected to the top of the container and a lid that is removably attached to the ring so as to close off the container. A similar arrangement is disclosed by U.S. Pat. No. 4,619,373, issued Oct. 28, 1986 to H. W. Galer. Other plastic paint can designs and/or apparatus for injection molding same are illustrated by the following U.S. Pat. No. 4,777,004, issued Oct. 11, 1988 to H. W. Galer; U.S. Pat. No. 4,619,373, issued Oct. 28, 1986 to H. W. Galer; U.S. Pat. No. 4,349,119 issued Sep. 14, 1982 to I. Letica; U.S. Pat. No. 4,512,494, issued Apr. 23, 1985 to J. W. Von Holdt; U.S. Pat. No. 4,383,519 issued May 17, 1983 to I. Letica; U.S. Pat. No. 4,293,080, issued Oct. 6, 1981 to I. Letica; and U.S. Pat. No. 3,977,563 issued Aug. 31, 1976 to W. G. Holt.

However, prior plastic paint can/lid designs have suffered from various limitations, such as need for complex and costly injection molds, not capable of being handled by standard filling, labeling and packaging machinery, inadequate strength, unreliable sealing of lid to container, and/or lack of appeal to prospective customers.

A new plastic container/removable lid construction is disclosed and claimed in my copending U.S. application Ser. No. 09/281,367, filed Mar. 30, 1999. The plastic container construction disclosed in my copending application offers numerous advantages. It has a one-piece construction free of any seams or crimps, does not rust internally and requires no internal protective coating, has a higher dynamic compression that metal paint cans, can be manufactured in different colors and surface finishes, weighs less than a metal can of comparable size and volume, can be molded with embossed printing so as to eliminate the need for a subsequent labeling operation, and is adapted to be closed off by a complementary lid that makes an air-tight seal and can be removed and replaced without damage. The container rim and a complementary lid are adapted to interlock in a manner which provides an air-tight friction fit, permits the lid to be easily removed by use of a prying tool, and assures that the lid cannot be accidentally dislodged as a consequence of being subjected to impact, shock or stress in the course of being stacked or transported.

SUMMARY OF THE INVENTION

The primary object or purpose of the invention is to provide a new and improved injection molding apparatus for use in manufacturing plastic containers that embody the construction disclosed and claimed in said copending U.S. application Ser. No. 09/281,367.

A more specific object is to provide an injection mold apparatus for manufacturing one-piece plastic containers having lid-receiving rims that project inwardly of the side walls of the containers.

Another specific object is to provide an injection mold assembly for molding plastic containers that does not require a collapsible core.

A further object is to provide an improved method of injection molding an improved plastic container for use in storing paint or other material.

A further is to provide a novel method and apparatus for manufacturing a plastic container that is adapted to releasably interlock with a lid in a manner that provides positive line contact sealing of the container.

Another object is to provide a novel method and apparatus for injection molding a one-piece, substantially straight-sided plastic container for paint or other liquid or particulate material that is characterized by a rim-to-lid interlock which provides an air-tight friction fit, permits the lid to be easily removed by use of a prying tool, and assures that the lid cannot be accidentally dislodged as a consequence of being subjected to impact, shock or stress due to rough handling in the course of being stacked or transported.

Still other objects and features of the invention are disclosed or rendered obvious by the following detailed description which is to be considered together with the accompanying drawings.

BRIEF DESCRIPTION OF THE DRAWINGS

FIGS. 7A to 10A are additional sectional views in front elevation that illustrate how the mold is operated;

FIGS. 7B to 10B are schematic sectional views in side elevation that illustrate different mold positions correspond to the positions shown in FIGS. 7A to 10A respectively;

DESCRIPTION OF CONTAINER AND LID

Figure 1:
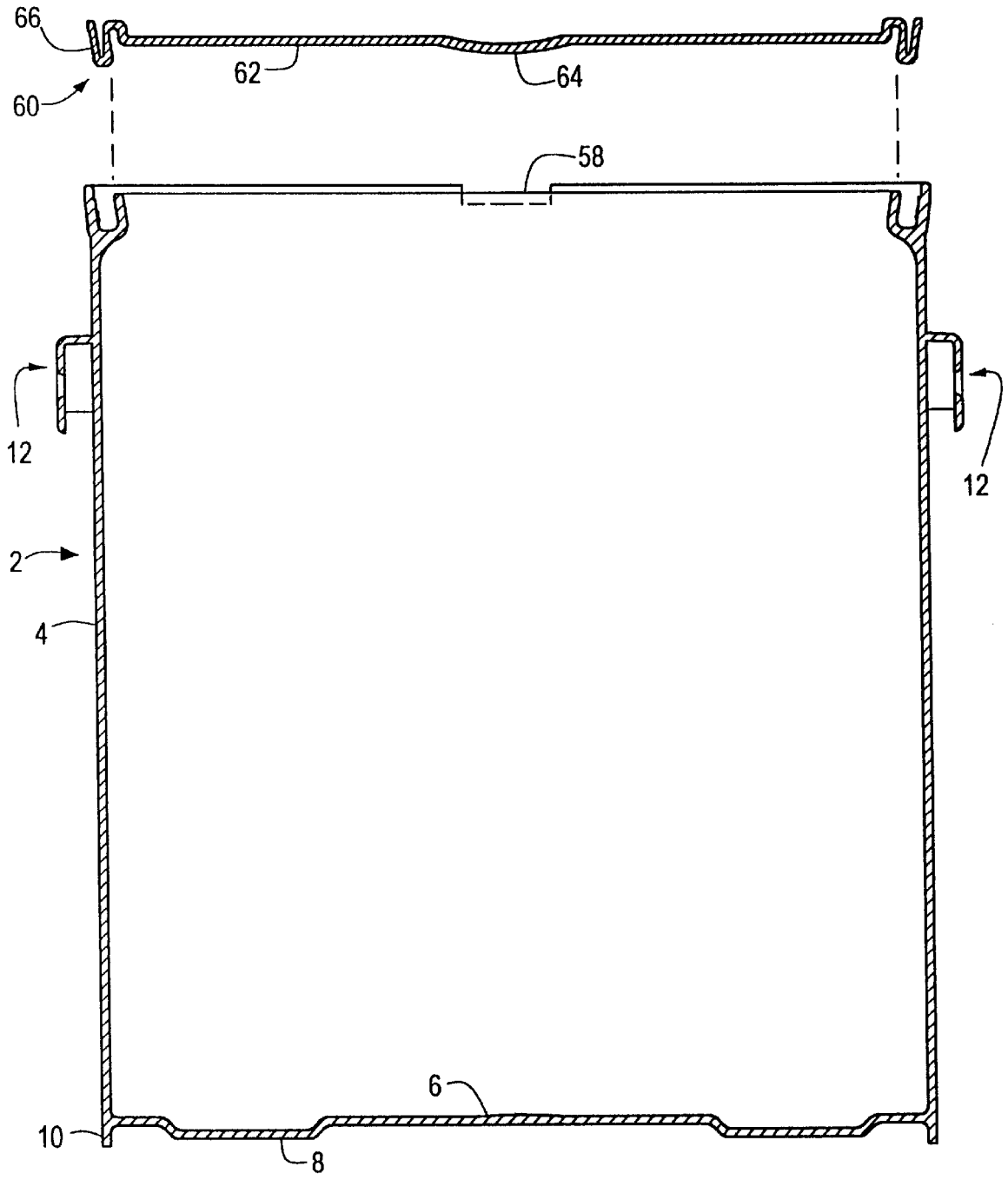
FIG. 1 is an exploded sectional view in elevation showing a container and a lid therefor that embody the invention disclosed in said copending application Ser. No. 09/281,367.

FIG. 1 illustrates an injection-molded substantially straight-sided container 2 and a lid 60 that embody the invention disclosed and claimed in said copending U.S. application Ser. No. 09/281,367. The disclosure of that copending application is incorporated herein by reference.

Figure 2:
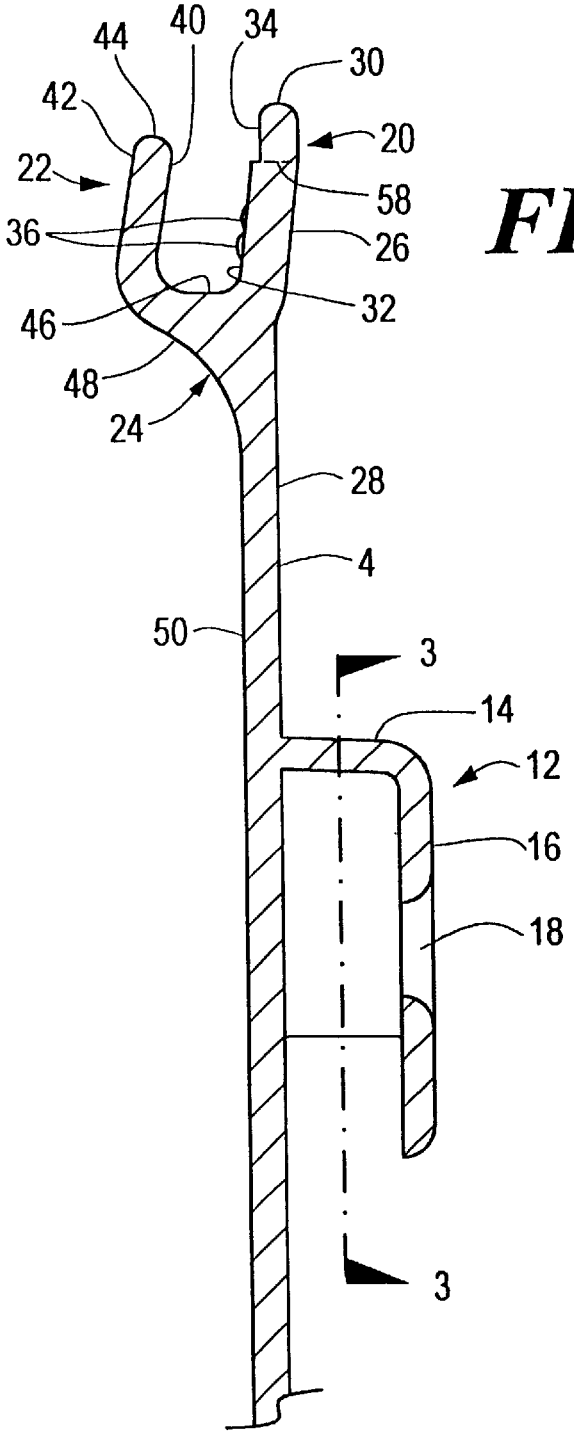
FIG. 2 is an enlarged scale fragmentary sectional view in elevation showing details of the rim on the upper end of the same container.
Figure 3:
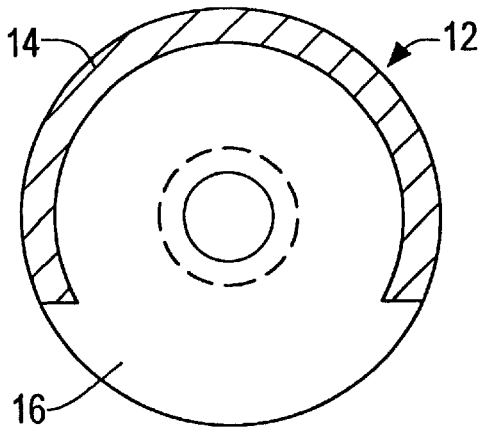
FIG. 3 is a sectional view taken along line 3—3 of FIG. 2.

Container 2 is made of a suitable plastic material that provides an adequate combination of resiliency and strength, e.g., high density polyethylene. Container 2 comprises a side wall 4, and a bottom wall 6 which preferably is contoured as shown to provide a flat annular downwardly projecting rib 8 for strengthening purposes. Side wall 4 is a substantially constant diameter cylinder. However, if desired, side wall 4 may be tapered so that the upper end has a slightly larger diameter than its bottom end. The bottom end of the paint can also has an axially extending seating flange 10 that forms a continuation of side wall 4. The side wall also has two diametrically opposed perforated ears 12. As seen in FIGS. 2 and 3, ears 12 comprise a curved side wall 14 that extends through an angle of at least 180° degrees, preferably about 200°, and a front wall 16 that has a tapered hole 18 for acceptance of one end of a wire handle (not shown) of the kind commonly used on metal paint cans. Hole 18 serves as a pivot point for the wire handle.

Referring specifically to FIG. 2, the upper end of the side wall 4 is formed with a split or bifurcated rim, the rim comprising an outer rim section 20, an inner rim section 22, and a rim-connecting section 24. The outer rim section 20 is essentially an extension of side wall 4 and has an outer surface 26 that preferably, but not necessarily, projects radially slightly beyond the outer surface 28 of side wall 4. Surface 26 may be a straight cylinder or, as shown, may extend at a slight angle to outer surface 28. Preferably, but not necessarily, the upper end edge of outer rim section 20 is rounded off as shown at 30. The inner surface of outer rim section 20 is identified generally by numeral 32. Inner surface 32 extends at a selected acute angle, e.g., an angle between 6 and 7°, to side wall 4 and the longitudinal center axis of the container. Preferably, but not necessarily, the diameter of the upper end of inner surface 32 is enlarged so as to provide an offset or recessed cylindrical surface portion 34 that extends substantially parallel to the longitudinal (vertical) axis of container 2. The inner surface 32 also is formed with two locking or gripping ribs 36 that are convex in cross-section and preferably extend around the full circumference of the container rim. Alternatively, the ribs 36 could be interrupted at selected points about the circumference of outer rim section 20.

The inner rim section 22 is located inwardly of side wall 4. Rim section 22 has substantially parallel outer and inner surfaces 40 and 42, with at least surface 40, but preferably also surface 42, extending at a selected acute angle, e.g., an angle between about 9° and 10°, to the side wall 4. Preferably, but not necessarily, surface 40 of rim section 22 is smooth. However, it could also be provided with gripping ribs similar to ribs 36. Preferably, but not necessarily, the upper end edge of rim section 22 is rounded as shown at 44.

Preferably but not necessarily, the rim-connecting section 24 is formed with a generally concave upper surface 46. The bottom surface 48 of section 24 preferably forms a gentle curved transition between the inner surface 42 of inner rim section 22 and the inner surface 50 of side wall 4.

Surfaces 32, 40 and 46 together define an annular locking channel for a lid 60 hereinafter described. In this connection, it should be noted that the surface 40 of inner rim section 22 is not parallel to the inner surface 32 of outer rim section 20; instead those surfaces are in a converging relation with one another away from rim-connecting section 24. Preferably they converge on one another at an angle of between about 2° and 4° with increasing distance from bottom wall 6. In other words, the spacing between surfaces 32 and 40 is greatest near surface 46 and smallest near the top end of rim section 22.

The outer rim section 20 is provided with one or more notches 58 at its upper edge (FIGS. 1 and 2) to facilitate removal of a plastic lid or cover 60. Lid 60 preferably is made of the same material as container 2. The lid is circular and comprises a generally flat center or crown section 62 that preferably, but not necessarily, is dimpled at its center as shown at 64, and a convoluted rim section identified generally by the numeral 66 that is adapted to mate with the bifurcated rim section of container 2.

Figure 4:
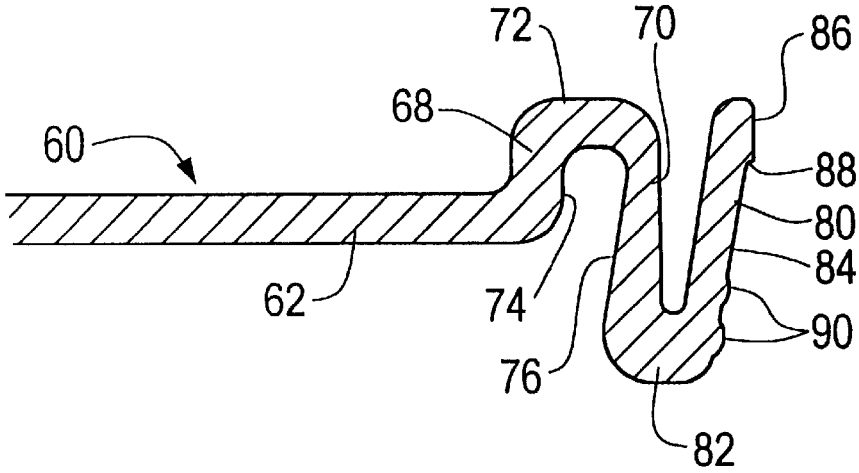
FIG. 4 is an enlarged fragmentary sectional view in elevation of the lid.

As seen best in FIG. 4, the convoluted rim section 66 of the lid or cover is characterized by a first upstanding circumferentially-extending rib that comprises an inner wall or leg section 68 that is joined to an outer wall or leg section 70 by a curved connecting wall section 72. The inner section 68 has an outer peripheral surface 74 that is substantially cylindrical and parallel to the center axis of the lid, while the outer section 70 has an inner circumferentially-extending surface 76 that is canted with the respect to the wall surface 74. Surface 76 is slanted extending downwardly and inwardly at an angle to the center axis of the lid that is approximately the same as the angle of the surfaces 32 and 40 relative to the center axis of the containers. Preferably, surface 76 extends at an angle of about 7° to 10° to the center axis of the lid.

The wall section 70 also forms part of a second downwardly projecting rib that also comprises an outer wall section 80 and a curved connecting wall section 82. Outer wall section 80 also has an outer surface 84 that extends at an angle that preferably is substantially the same as the angle of the surface 76. Alternatively, wall section 80 may be formed so that the angle of outer surface 84 relative to the lid's center axis is slightly greater than the angle of surface 76, e.g., 1°–3° greater. The upper end of wall section 80 has an outer peripheral surface portion 86 that is essentially cylindrical and is parallel to the center axis of the lid. Surface portion 86 projects outwardly beyond surface 84, so as to form a shallow shoulder or ledge 88. Additionally the outer surface 84 is provided with a pair of locking or gripping ribs 90 that preferably are convex in cross-section as seen in FIG. 4. Ribs 90 are designed to mate and interlock with the similarly shaped ribs 36 formed on the container rim. Ribs 90 preferably extend around the full circumference of surface 84, but alternatively they could be interrupted at selected points about the circumference of surface 84.

Making the container and lid of a resilient strong material such as a high density polyethylene is advantageous, particularly in the case of making one gallon paint cans, in that the material provides the container with sufficient strength to resist deformation under the weight of one or more like-filled containers. At the same time, the plastic material can flex sufficiently to allow the lid to be secured in place on the container so as to seal off the container's contents.

Figure 5:
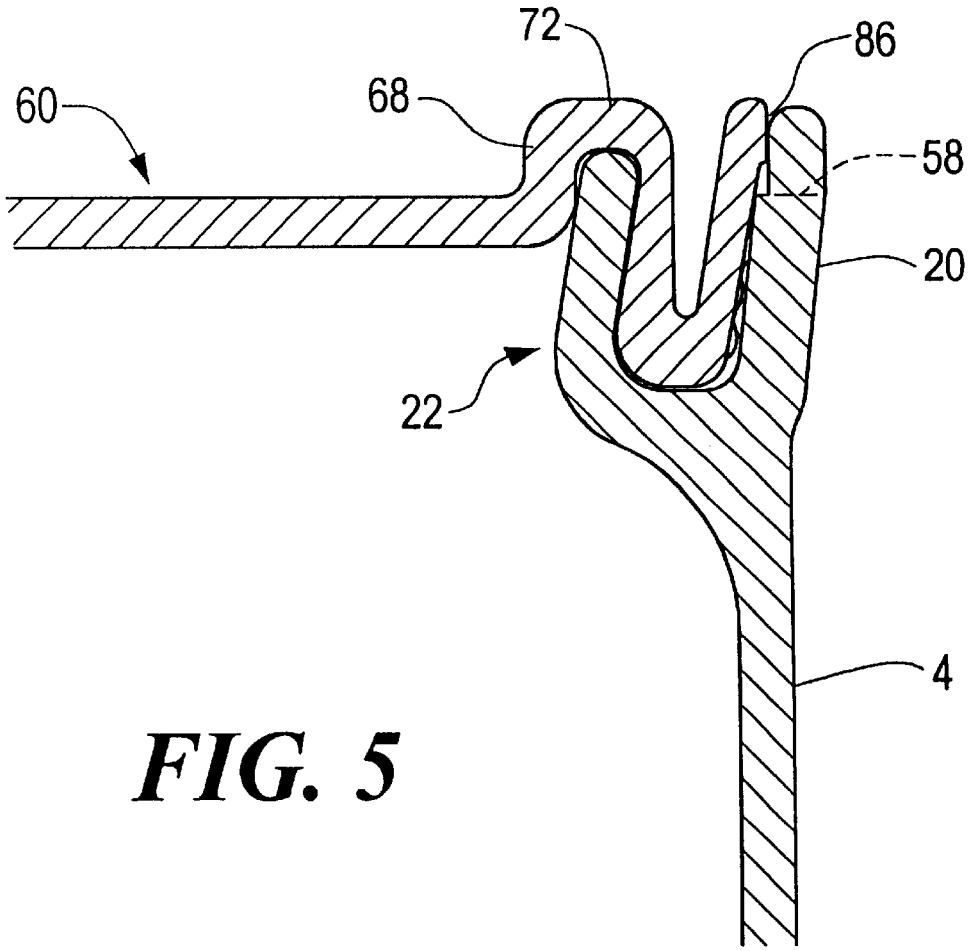
FIG. 5 is a fragmentary sectional view on an enlarged scale showing how the lid interlocks with the rim of the container.

The downwardly projecting rib on the lid formed by wall sections 70, 80 and 82 is designed to make a friction fit in the channel formed between the outer and inner rim sections 20 and 22 of the container. The distance between the surfaces 76 and 84 of the downwardly projecting rib of the rim may be equal to but preferably is slightly in excess of the distance between the surfaces 32 and 40 of container rim sections 20 and 22 respectively. However, that rib is sufficiently resilient as to allow sections 70 and 80 to be forced toward one another under a radial compressing force. Consequently, as shown in FIG. 5, when the lid is attached to the rim section of the container, the depending rib comprising wall sections 70, 80 and 82 makes a tight friction fit in the channel between rim sections 20 and 22, with the gripping ribs 90 interlocking with gripping ribs 36.

When the lid is attached to the container, its periphery is surrounded and protected by the upper end of rim section 20. The maximum outside diameter of the combined container and lid is essentially the outside diameter of the outer rim section 20 measured at the upper edge of its outer surface 26. Since that diametrical dimension is nearly the same as that of the outer diameter of wall 4, the container with the lid attached has an appearance substantially the same as a sealed conventional metal paint can. Removal of the lid from the can is facilitated by the presence of notches 58 in the upper end of rim section 20. Notches 58 permit a screwdriver or other tool to be engaged with shoulder 88 to pry the lid off of the container.

DESCRIPTION OF THE PREFERRED EMBODIMENT

A preferred embodiment of the mold assembly of the present invention is a mold assembly as shown in the drawings that is designed to produce a one gallon container having the construction shown in FIGS. 1–3.

Figure 6A:
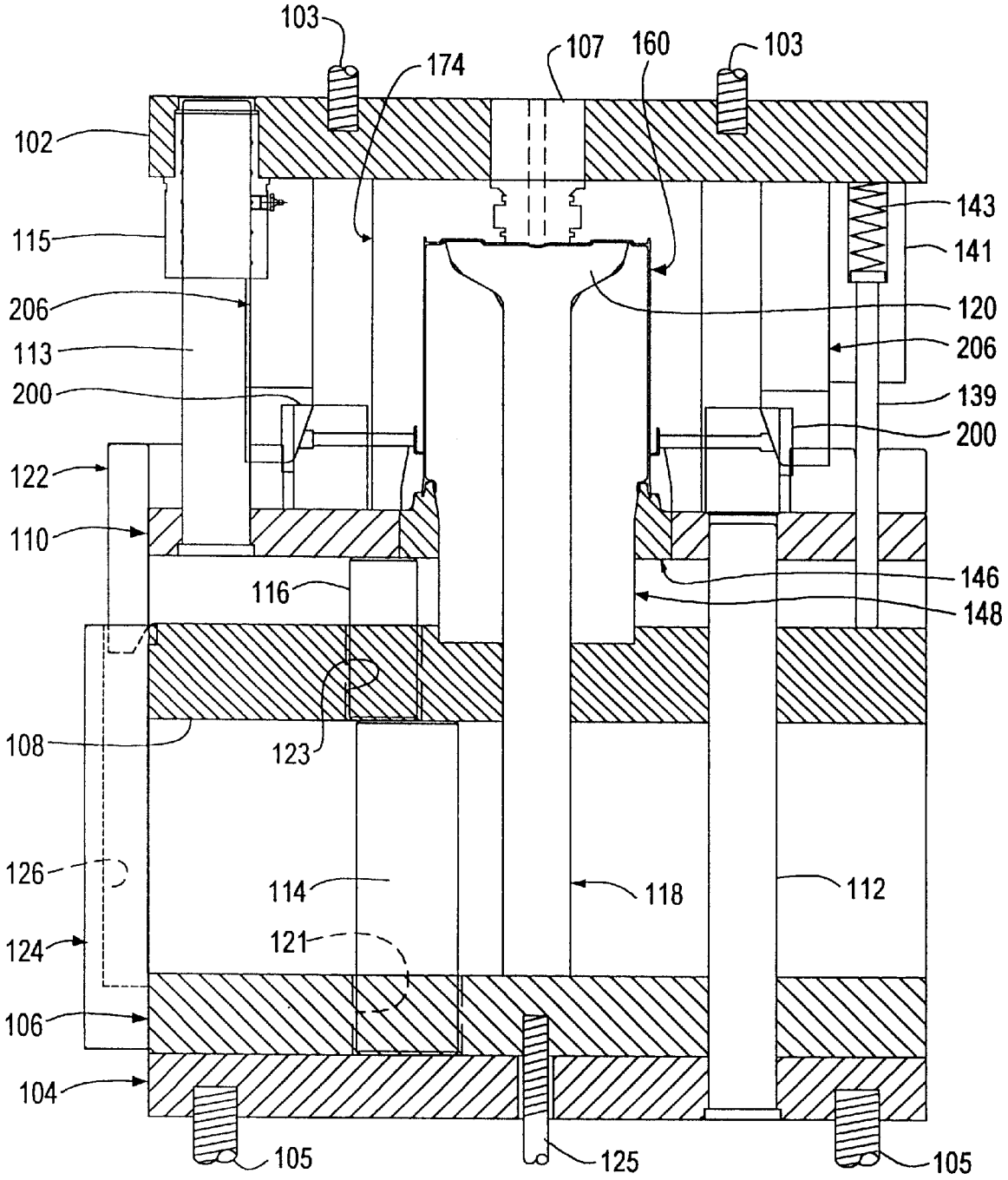
FIG. 6A is a schematic sectional view in front elevation of a mold assembly embodying the present invention in fully closed position.
Figure 6B:
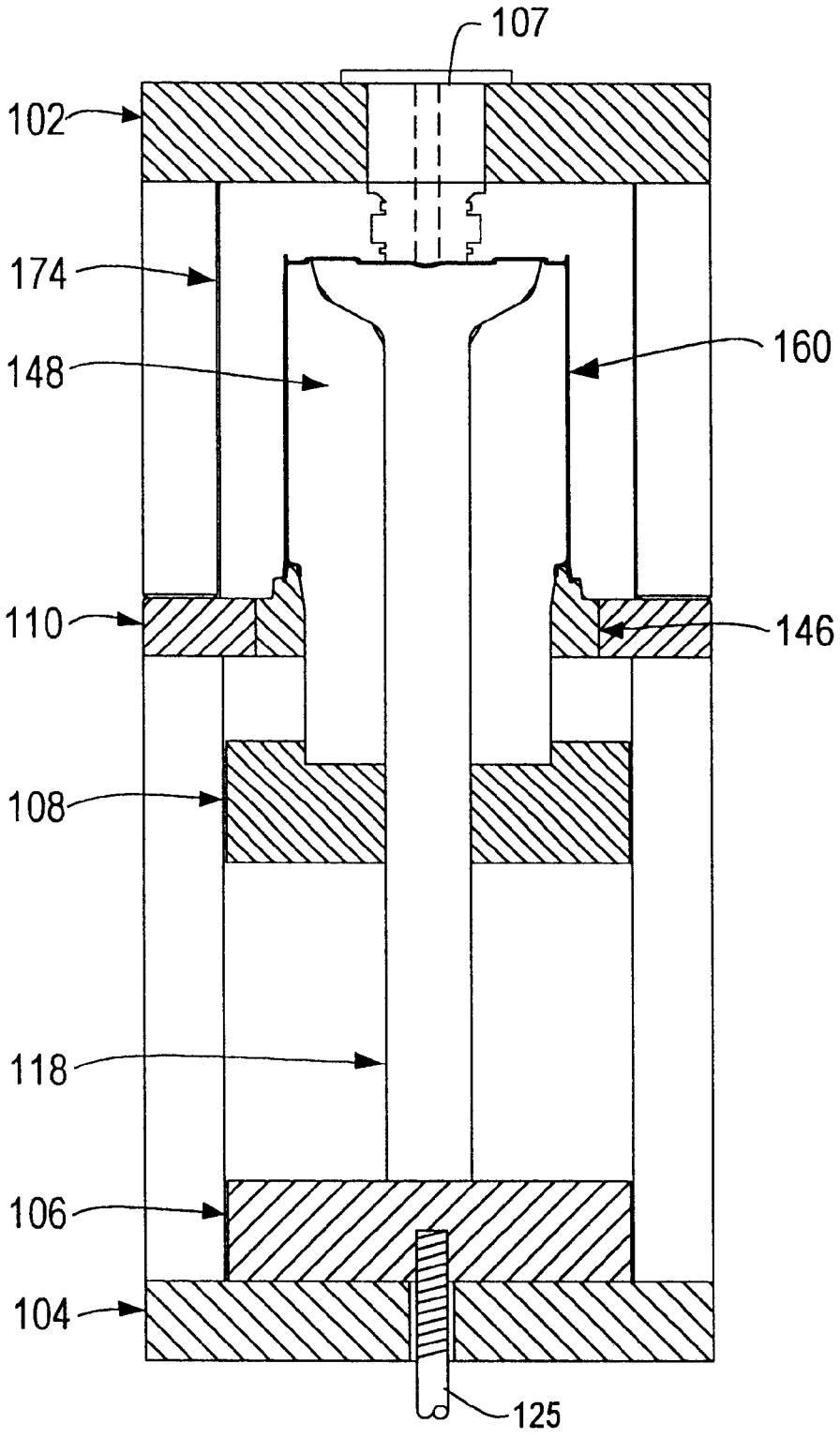
FIG. 6B is a schematic sectional view is side elevation of the same mold assembly in closed position.

Referring now to FIGS. 6A and 6B, there is shown a mold assembly that comprises a first or front plate 102, a second or back plate 104, an ejector plate 106, a core support plate 108, and a support plate 110. Use of the terms "front" and "back" is premised on the fact that in conventional injection molding machines the molds are generally oriented horizontally, i.e., rotated 900° from the position shown in the drawings, and they open and close by relative movement along a horizontal axis. However, the mold assembly is illustrated with a vertical orientation in the drawings for the purpose of making it easier to understand its construction and mode of operation.

The front plate 102 is adapted to be securely mounted by threaded bolts 103 to a stationary platen (not shown) of an injection molding machine (also not shown), while back plate 104 is adapted to be mounted by additional threaded bolts 105 to a movable platen (not shown) of the same injection molding machine. Front plate 102 has a sprue hole that is fitted with a hollow sprue bushing 107 for connection to a source of plastic material to be injected into the mold assembly. A plurality of leader pins or guides 112 (only one of which is shown in FIG. 6A) are fixed to and extend between back plate 104 and support plate 110. A second plurality of leader pins or guides 113 (only one of which is shown in FIG. 6A) are fixed to support plate 110 and mounted in telescoping relation to guide bushings 115 attached to front plate 102. A support pillar in the form of a solid cylindrical rod 114 is fixed to back plate 104 and extends toward the support plate 110. Ejector plate 106 and core plate 108 have slide holes 117, 119 through which leader pins 112 extend, with the slide holes being sized so that leader pins 112 prevent lateral movement of the ejector and core plates while allowing them to move lengthwise of the leader pins toward and away from support plate 110. Ejector plate 106 also has a slide hole 121 through which extends support pillar 114. Pillar 114 terminates a predetermined distance from back plate 104, and functions as a rear stop member for core plate 108. A second support pillar in the form of a solid cylindrical rod 116 is attached to and partially overlaps the adjacent end of support pillar 114. Support pillar 116 extends through a slide hole 123 in core plate 108 and engages support plate 110. Support pillars 114 and 116 together prevent support plate 110 from collapsing away from front plate 102 under molding pressure when the mold assembly is closed and injected with plastic as described hereinafter. Four pressure pins 139 (only one of which is shown) are slidably mounted in bushings 141 affixed to front plate 102. Pins 139 and bushings 141 are distributed in a rectangular pattern around cavity member 174 (described hereinafter). A coil compression spring 143 in bushing 141 urges pin 139 toward core support plate 108. The purpose of pin 139 is to urge plate 108 back away from plate 110 as the mold assembly moves from the fully closed position of FIGS. 6A, 6B to the open position shown in FIGS. 9A, 9B and 10A, 10B.

The ejector plate 106 is adapted to be connected by a threaded member 125 to an operating member of the injection molding machine (not shown) which moves it toward and away from the front plate 2 during the injection molding cycle described hereinafter. Member 125 extends through a hole 127 in back plate 104 that is sized to allow reciprocal axial motion of member 125. Fixed to ejector plate 106 is a poppet 118 having an enlarged head 120 at its front end. Poppet 118 extends slidably through a hole in core plate 108.

Figure 11:
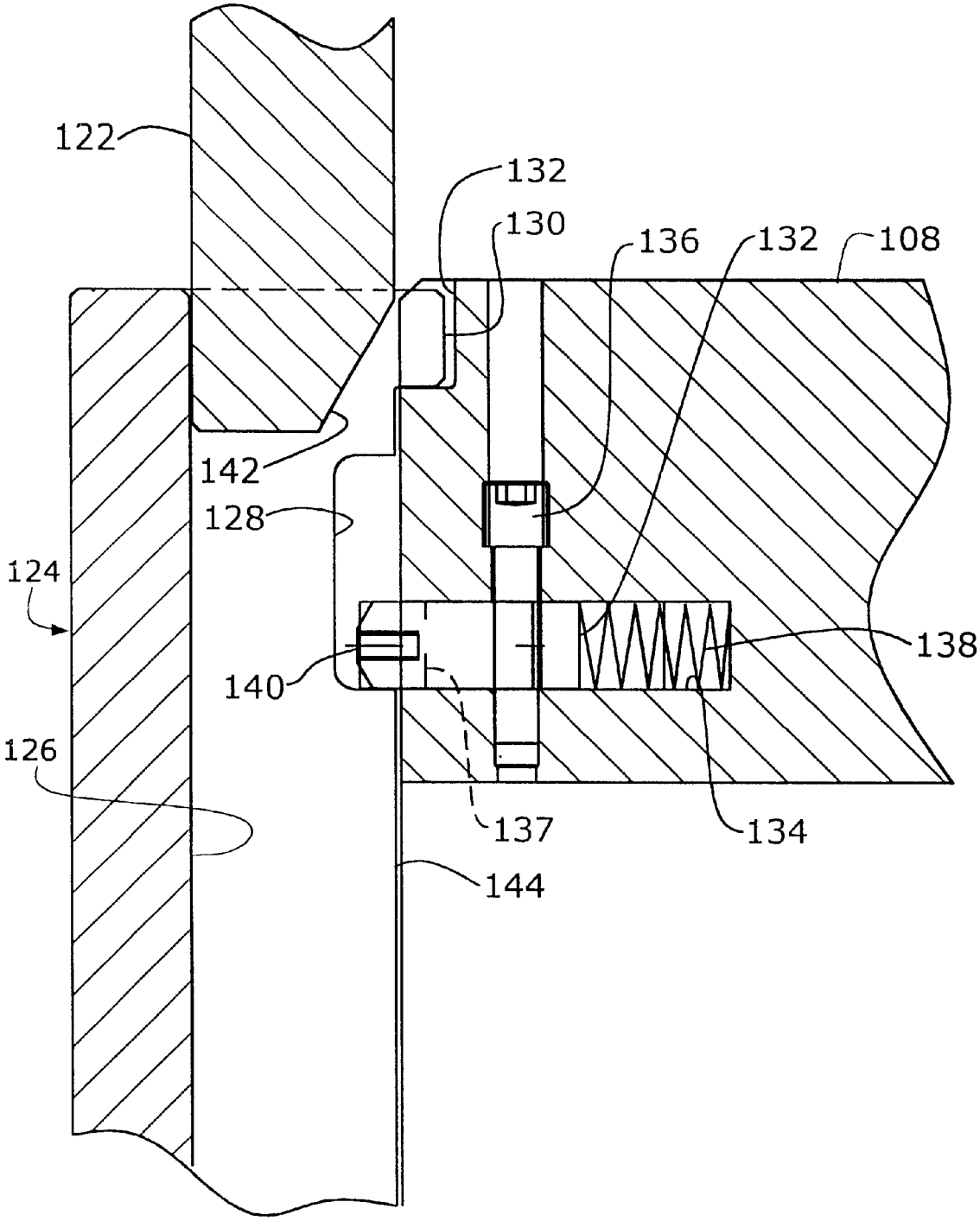
FIG. 11 is a fragmentary sectional view on an enlarged scale showing the core plate latching mechanism with the mold assembly in the fully closed position.

A cam bar 122 is attached to the periphery of support plate 110. Cam bar 122 projects rearwardly from support plate 110 toward back plate 104. Attached to ejector plate 106 in line with cam bar 122 is a latch bar 124. Bar 124 is slotted longitudinally as indicated at 126 to slidingly receive cam bar 122. The open side of slot 126 faces core plate 108. Referring now to FIGS. 6 and 11, the inner edge of latch bar 124 is notched as shown at 128, and the forward end of the latch bar preferably has a projection 130 that extends into a notch 132 in the periphery of core plate 108. The notch 128 serves to receive a flat detent pin 132 that is mounted in a radially-extending hole 134 in core plate 108. A threaded lock pin 136 screwed into a tapped hole in core plate 108 extends through an elongate hole 137 in detent pin 132 to limit axial movement of the detent pin in hole 134. A compression spring 138 in hole 134 urges detent pin 132 into notch 128. The back edge of notch 128 forms a flat shoulder 140 which is intercepted by the detent pin 132 when the pin is in its extended position (FIG. 11). Consequently when ejector plate 106 is moved forward toward front plate 2, the movable latch bar 124 acts through detent pin 132 to releasably lock core plate 108 to ejector plate 106, thereby causing the core plate to move forward with the ejector plate.

However, cam bar 122 has an inclined inner edge cam surface 142 at its back end. Surface 142 is positioned to engage detent pin 132 when core plate 108 moves with ejector plate 106 towards support plate 110. As ejector plate 106 and core plate 108 move toward support plate 110, the slanted edge cam surface 142 of cam member 122 engages detent pin 132 and cams the detent pin into cavity 134 out of engagement with shoulder 140, thereby freeing movable latch bar 124 (and hence ejector plate 106) from its locked connection to core plate 108. Cam bar 122 and movable latch bar 124 are sized and disposed so that the cam surface 142 engages and pushes the detent pin back into the cavity 134 just as the core plate 108 engages the stationary support plate 110, thus freeing the ejector plate from the core plate so as to allow the ejector plate to continue moving toward the front plate, carrying with it the poppet 118. During further movement of ejector plate 106 toward front plate 102, the inner edge 144 of latch bar 124 holds the detent pin in its retracted position.

Support plate 110 has a center hole in which is fixed a ring member 146. The latter in turn surrounds a core member 148 which is fixed to core plate 108. Core member 148 has a center hole 150 which slidably receives poppet 118. The upper end of hole 150 is tapered outwardly, i.e., flared, as shown at 152 (FIG. 7A) so as to nestingly receive the enlarged head 120 of poppet 118.

Figure 12:
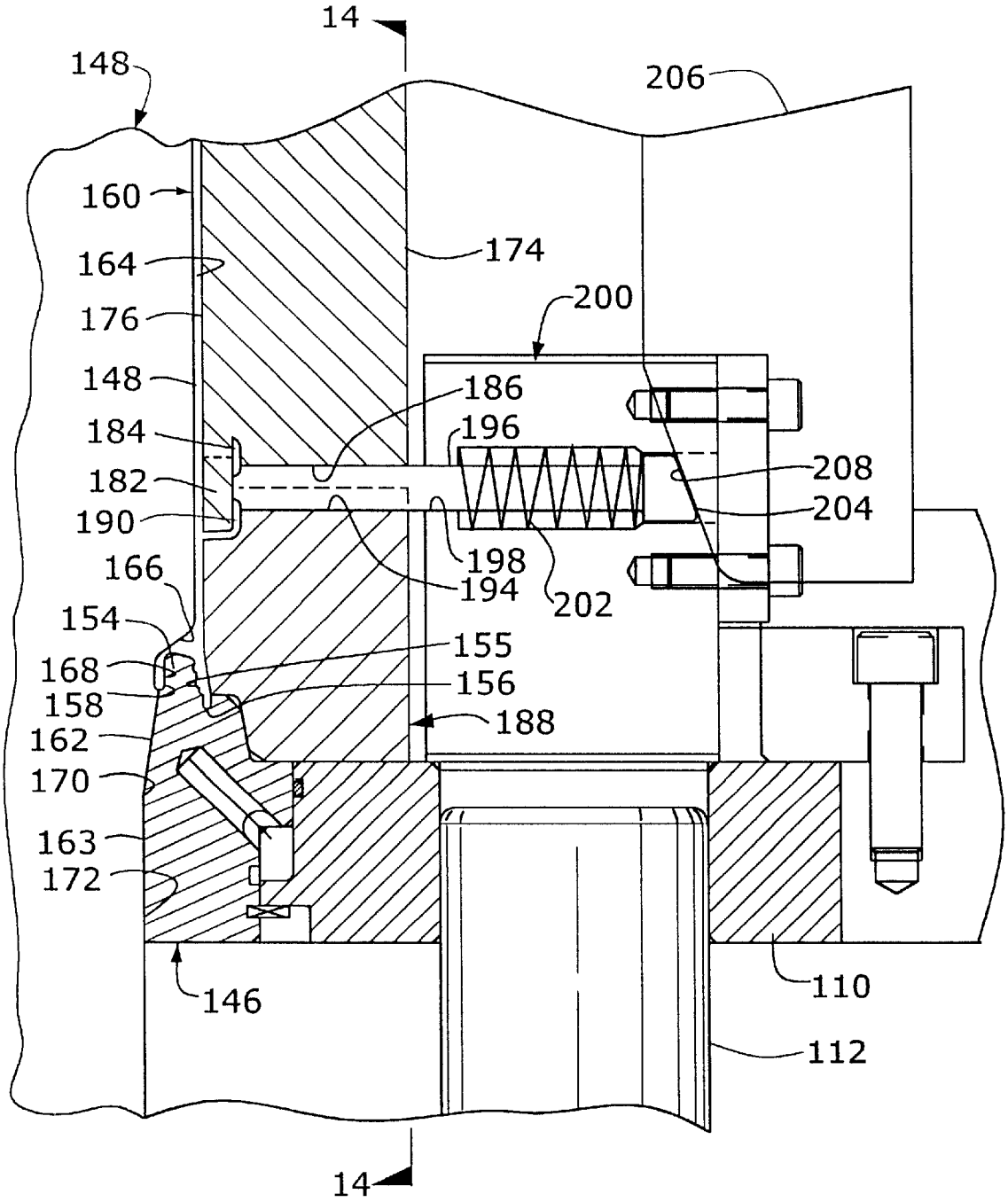
FIG. 12 is a fragmentary sectional view on an enlarged scale of the components of the mold assembly for molding the rim section and one of the ear sections of the container shown in FIGS. 1–3.
Figure 13:
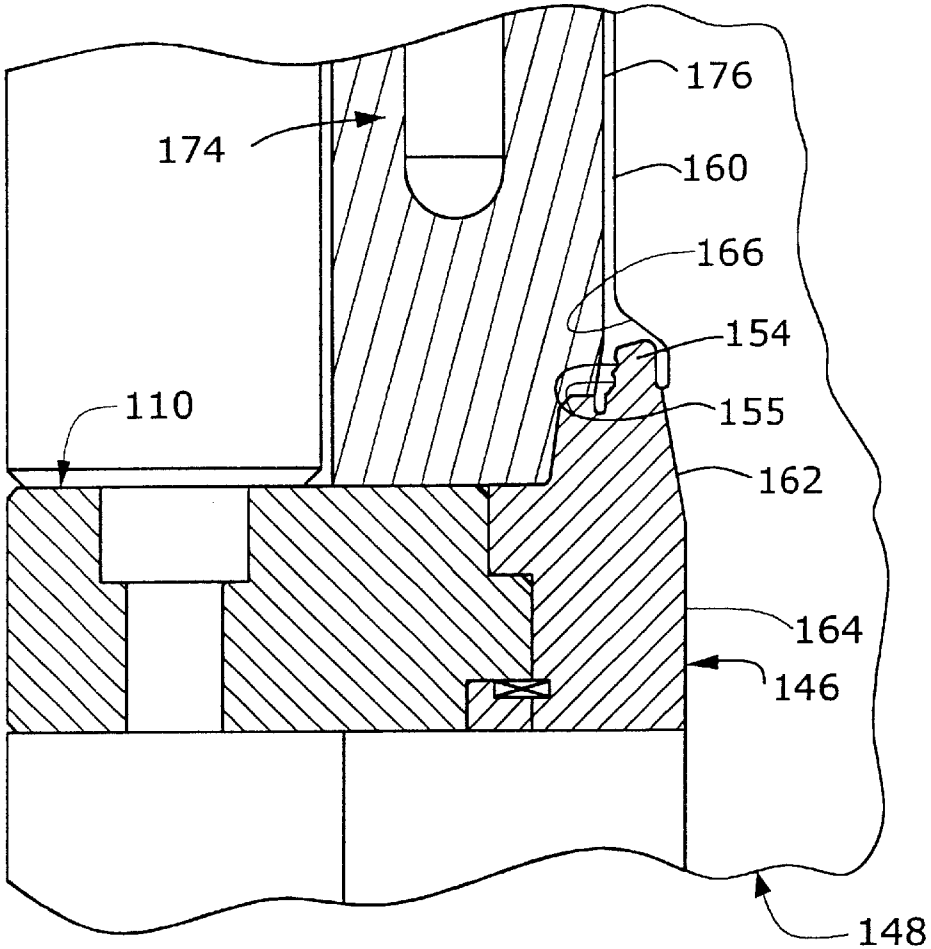
FIG. 13 is a fragmentary sectional view similar to FIG. 12 taken at a position that is located approximately 90° away from the viewpoint of FIG. 11.
Figure 15:
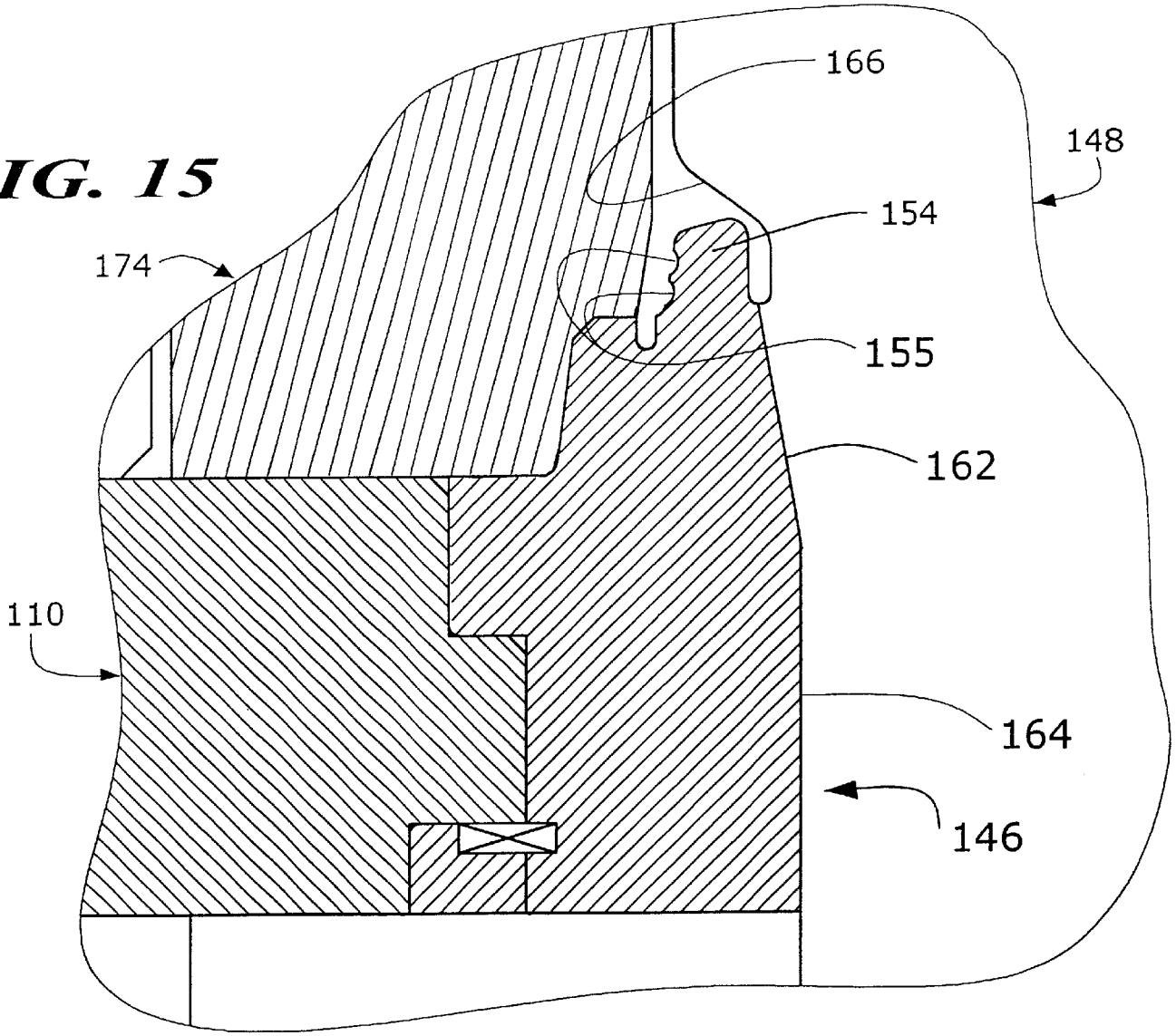
FIG. 15 is an enlargement of a portion of FIG. 13.

Turning now to FIGS. 12 and 13, ring member 146 is formed at its front end with a forwardly projecting annular rib 154. Rib 154 is sized and contoured so as to conform to and mold the surfaces 32, 40 and 46 and a part of the surface 26 of rim sections 20, 22 and 24 of the container shown in FIGS. 1–3. In this connection, it should be noted that FIGS. 12 and 13 illustrate at 160 the injected plastic material that forms the container. Rib 154 has a pair of grooves 155 (FIG. 13) on its inner surface which are shaped to form the locking projections 36 shown in FIGS. 2 and 5. The inner side of ring member 146 is provided with a tapered surface portion 162 which is joined to a cylindrical surface section 163. As shown in FIG. 12, the inner diameter of ring member 164 is smallest at cylindrical surface section 163.

Referring now to FIGS. 6A–10B, 12 and 13, the core 148 is formed with a generally cylindrical outer surface 164 which is joined to a reduced diameter tapered surface 166. The latter surface joins a surface 168 which is shaped to form the inner surface of rim section 22 of the container. Rearwardly of surface 168 the core 148 has surfaces 170 and 172 which are contoured so as to mate with the surfaces 162 and 164 respectively of ring 146.

Referring again to FIGS. 6A–10B, 12 and 13 a cavity member 174 is secured to front plate 102. The latter has a cavity defined by a cylindrical side surface 176 and an end surface 178 which are shaped to conform to and mold the outer surfaces of side wall 4 and end wall 6 respectively of the container shown in FIGS. 1–3. The inner end surface of bushing 107 is shaped to conform to and mold the center part of the outer surface of end wall 6 of the same container. Accordingly, bushing 107 may be considered as part of cavity member 174.

Figure 14:
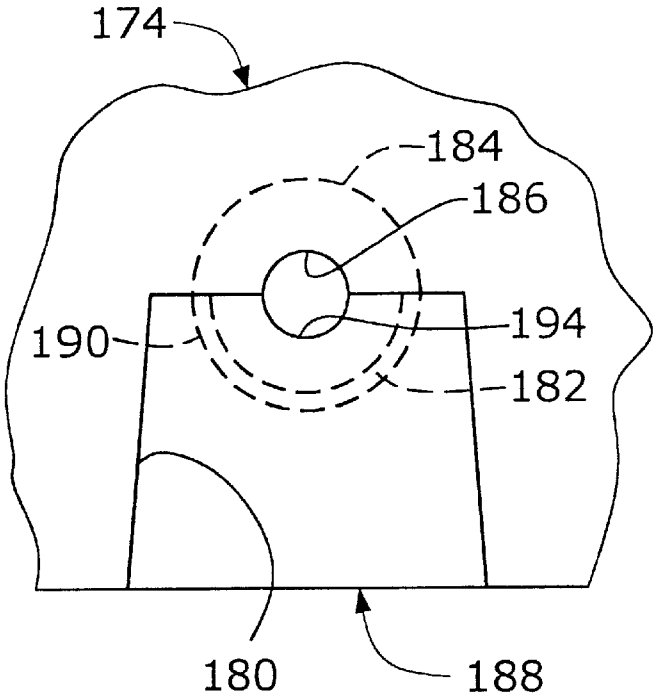
FIG. 14 is a fragmentary sectional view taken along line 14—14 of FIG. 12.

Referring to FIGS. 12 and 14, cavity member 174 is formed with two diametrically opposed slots 180 and two circularly curved extensions 182 at the inner ends of slots 180 (for convenience, only one slot 180 and one extension 182 is shown). As seen in FIG. 12, a flat circular groove 184 is formed in cavity member 174 adjacent each extension 182. Also the side of each slot 180 facing front plate 102 is formed with a semi-cylindrical groove 186 that extends to groove 184.

Disposed in each of the two diametrically-opposed slots 180 is an insert block 188. The inner face of each insert block 188 is formed with a semicircular slot 190 that complements the adjacent extension 182 of cavity member 174, but is sized so as to leave a gap therebetween to receive plastic material to form one of the ears 12 on the container. Each insert block 188 also has a semi-cylindrical groove 194 that complements the adjacent groove 186 in cavity member 174. Each pair of grooves 186 and 194 forms a cylindrical hole in which is located a core pin 196 (FIG. 12).

Core pin 196 is slidably mounted in a bore 198 in a block 200 that is an extension of insert block 188 and is affixed to support plate 110. A spring 202 surrounds the shaft of each pin 196 in an enlarged part of bore 198 and acts against the pin head 204 to urge the pin away from the core 48. The inner end of each core pin 196 is tapered (beveled) to conform to the tapered openings 18 in ears 12. Core pins 196 are moved toward core 148 by means of two cam bars 206 that are attached to and extend rearwardly from front plate 102. Cam bars 206 occupy diametrically opposed positions relative to the axis of core member 148. Each cam bar 206 is aligned with one of the blocks 200, and each block 200 is slotted fore and aft (vertically as viewed in FIGS. 6A, 7A and 12), with that slot being sized so that the associated cam bar 206 makes a close sliding fit therein. The inner end of each cam bar 206 has a slanted cam surface 208 that is located so that it can engage the head 204 of the adjacent core pin 196 when the mold assembly is closed (FIG. 6). In this connection it should be noted, as shown in FIG. 12) that the outer end surface of each core pin head 204 is slanted at substantially the same angle as cam surface 208, so as to facilitate camming of core pin 196 by cam bar 206 in the manner hereinafter described. When the mold assembly is moved to its closed position (FIGS. 6A, 6B), blocks 200 move with back plate 104 and support plate 110 toward front plate 102, causing core pin heads 204 to engage cam surfaces 208 of cam bars 206, whereupon the core pins 196 are cammed inwardly toward core 148. The cam surfaces 208 force core pins 196 inward to a limit position in which their tapered inner ends are spaced from curved cavity extensions 182 by an amount equal to the desired thickness of walls 16 of ears 12.

Referring now to FIGS. 7A, 7B and 10A, 10B, it is to be noted that the end surface 129 of head 120 of poppet 118 forms a mirror image of a major portion of the inner end surface 178 of cavity member 174, and the inner end surface of bushing 107, and that the corresponding annular end surface 149 of core member 148 is the mirror image of the remainder of surface 178, i.e., the front end surface 129 of head 120 of poppet 118 and the surrounding end surface 149 of core member 148 cooperate with inner end surface 178 of cavity member 174 and the inner end surface of bushing 107 to define the container bottom wall section of the mold cavity in which the container is molded. Also, ring member 146 acts as an auxiliary cavity member since it forms an extension of cavity member 174 and coacts with core member 148 to determine the shape of the rim section of the formed container 160. Accordingly when the mold is closed, the confronting and mutually spaced surfaces of core member 148 and ring member 146, cavity member 174 and insert blocks 188 coact to define the container side wall section and the container rim section of the mold cavity in which the container is molded.

Operation of the above-described mold assembly is straightforward. Assume that the mold assembly is mounted in an injection molding machine, with front plate 2 and back plate 4 secured to a fixed platen and a movable platen respectively of the machine. Assume also that ejector plate 6 is attached to a mechanical operator (not shown) that forms part of the same injection molding machine and is adapted to move the ejector plate toward and away from front plate 2 at predetermined times during the operating cycle of the machine. The sprue hole bushing 107 is connected to a source of plastic (not shown) which is to be injected into the closed mold assembly via a suitable injection pump (also not shown). Assume also that the machine has just completed its operating cycle, so that (1) the mold is in its fully closed position (FIGS. 6A, 6B), with ejector plate 106 engaging or located adjacent to back plate 104, and core plate 108 locked to ejector plate 106 by latch bar 124 and spaced back from support plate 110; and (2) a formed plastic container 160 occupies the mold cavity defined by core 148, cavity member 174, sprue bushing 107, ring 146, insert blocks 188 and core pins 196. The machine is programmed so as to automatically and repeatedly execute an operating cycle which comprises the following steps starting with the mold in the closed position shown in FIGS. 6A and 6B.

Figure 7A:
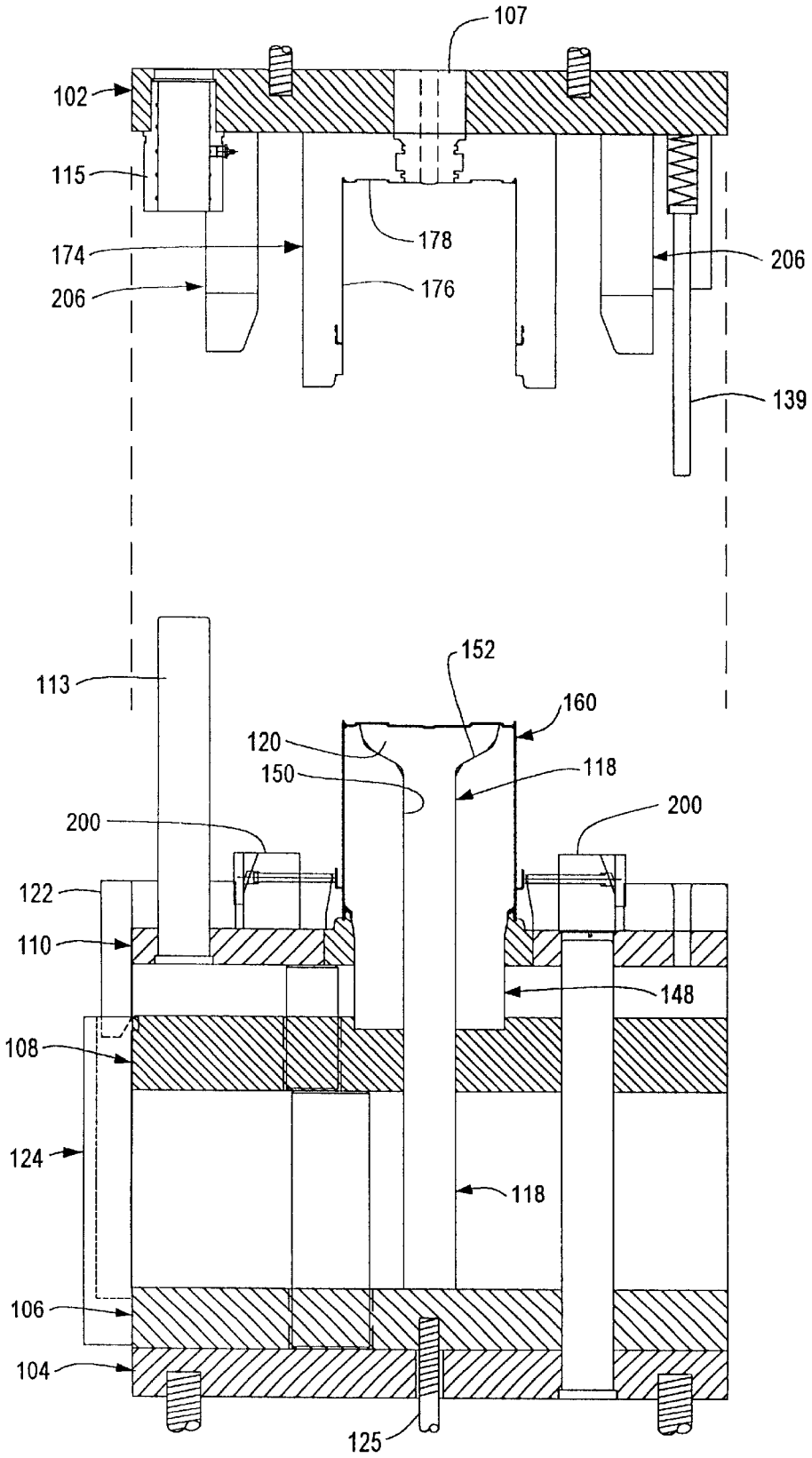
Figure 7B:
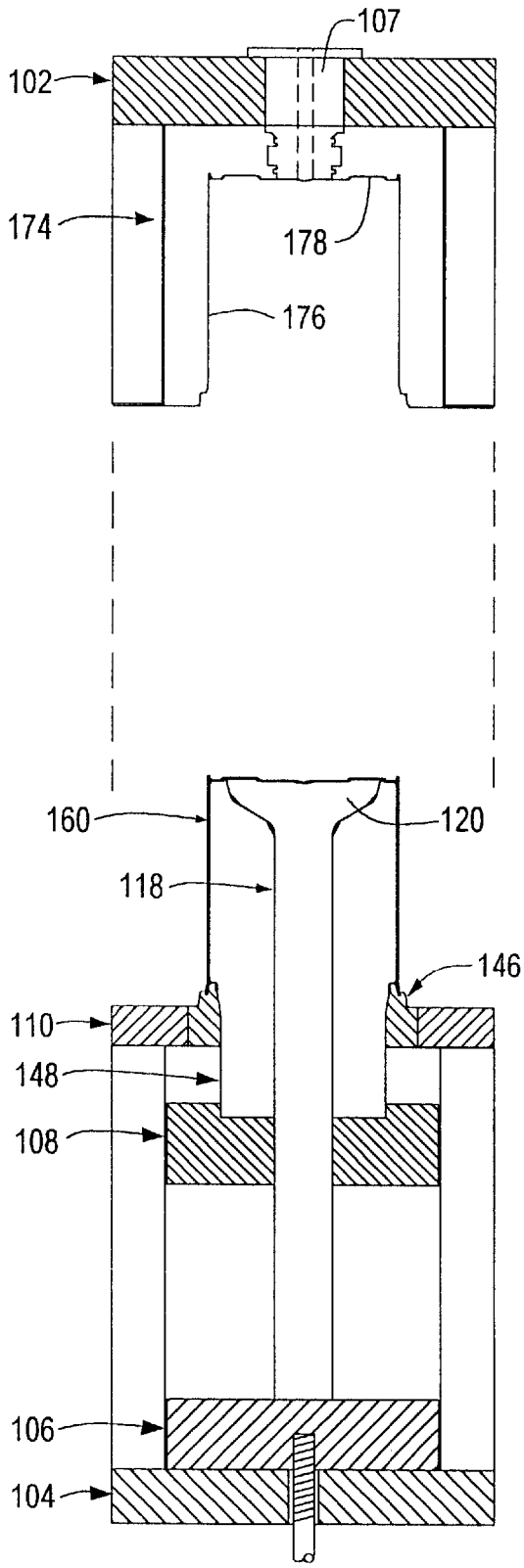
Figure 10A:
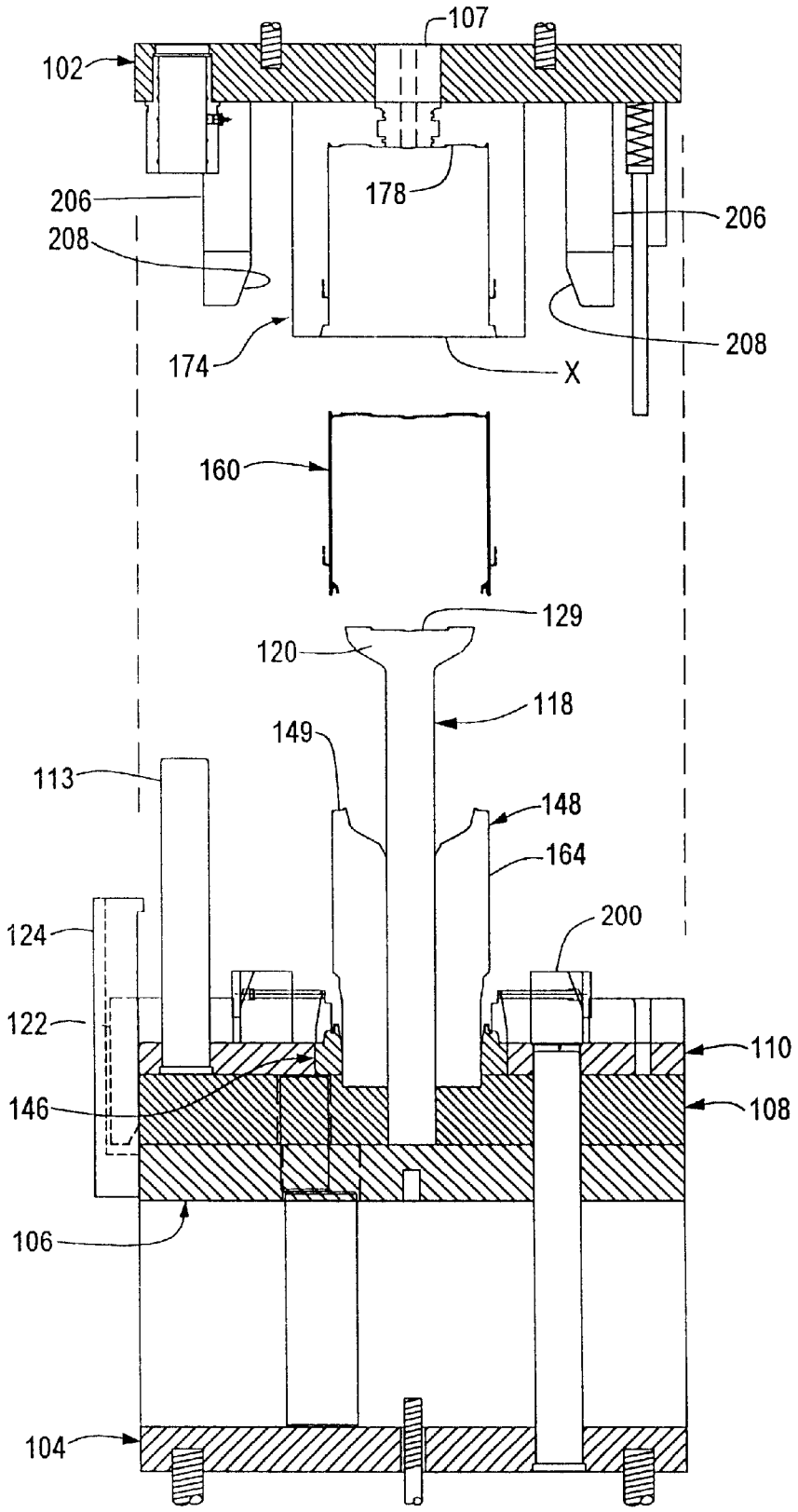
Figure 10B:
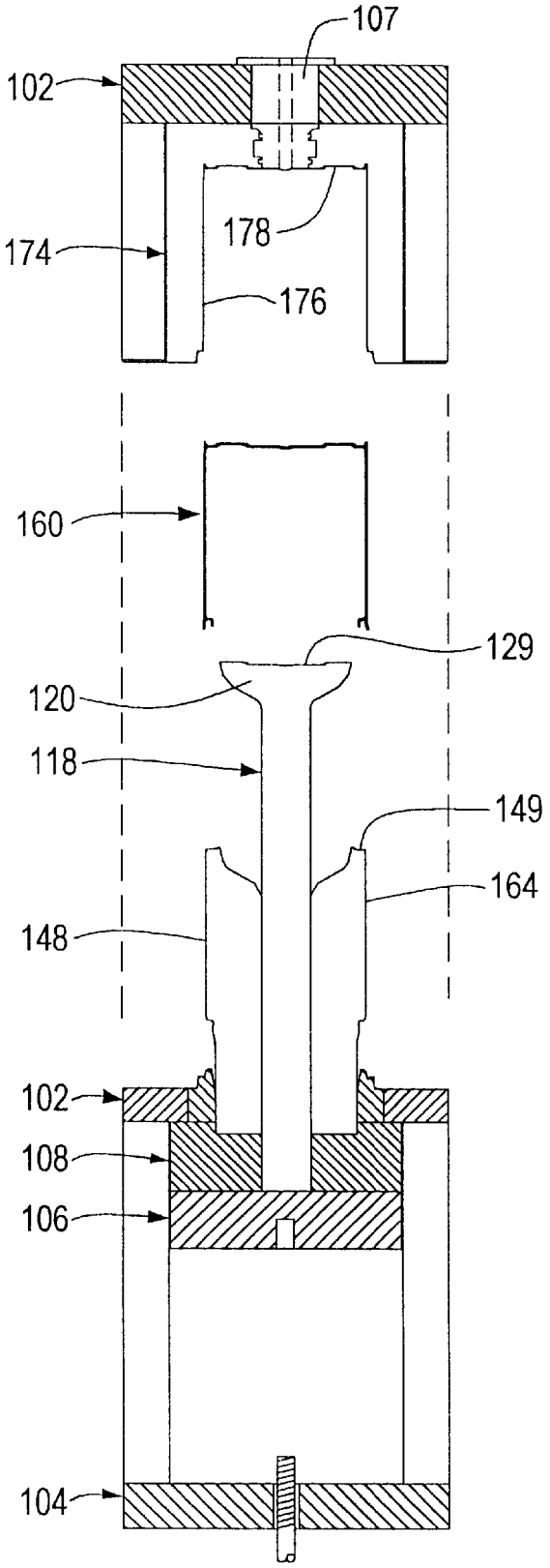

1. The mold is opened by moving back plate 104 and ejector plate 2106 together away from front plate 102 (FIGS. 7A, 7B). When the mold is opened, the back plate 104 is moved away from front plate 102 a distance that exceeds the longitudinal dimension of the cavity of cavity member 174 by an amount sufficient to permit subsequent removal of the formed container 160 (FIGS. 10A, 10B). The rearward movement of back plate 104 away from front plate 102 causes blocks 188 and 200 to move clear of cam bars 206, freeing core pins 196 and allowing springs 202 to move those core pins outwardly away from the curved extensions 182 of cavity member 174. It should be noted that during the rearward mold-opening movement of back plate 104 and ejector plate 106, the core plate 108 remains locked to ejector plate 106. As the mold is opened, the formed container 160 remains in place because of its interlocking engagement with ring member 146 and core member 148. Spring 143 acts to extend pressure pins 139 as the mold is opened, causing the pins to exert a force on core plate 108 so as to prevent the latter from moving away from back plate 104 in the direction of plate 102.

Figure 8A:
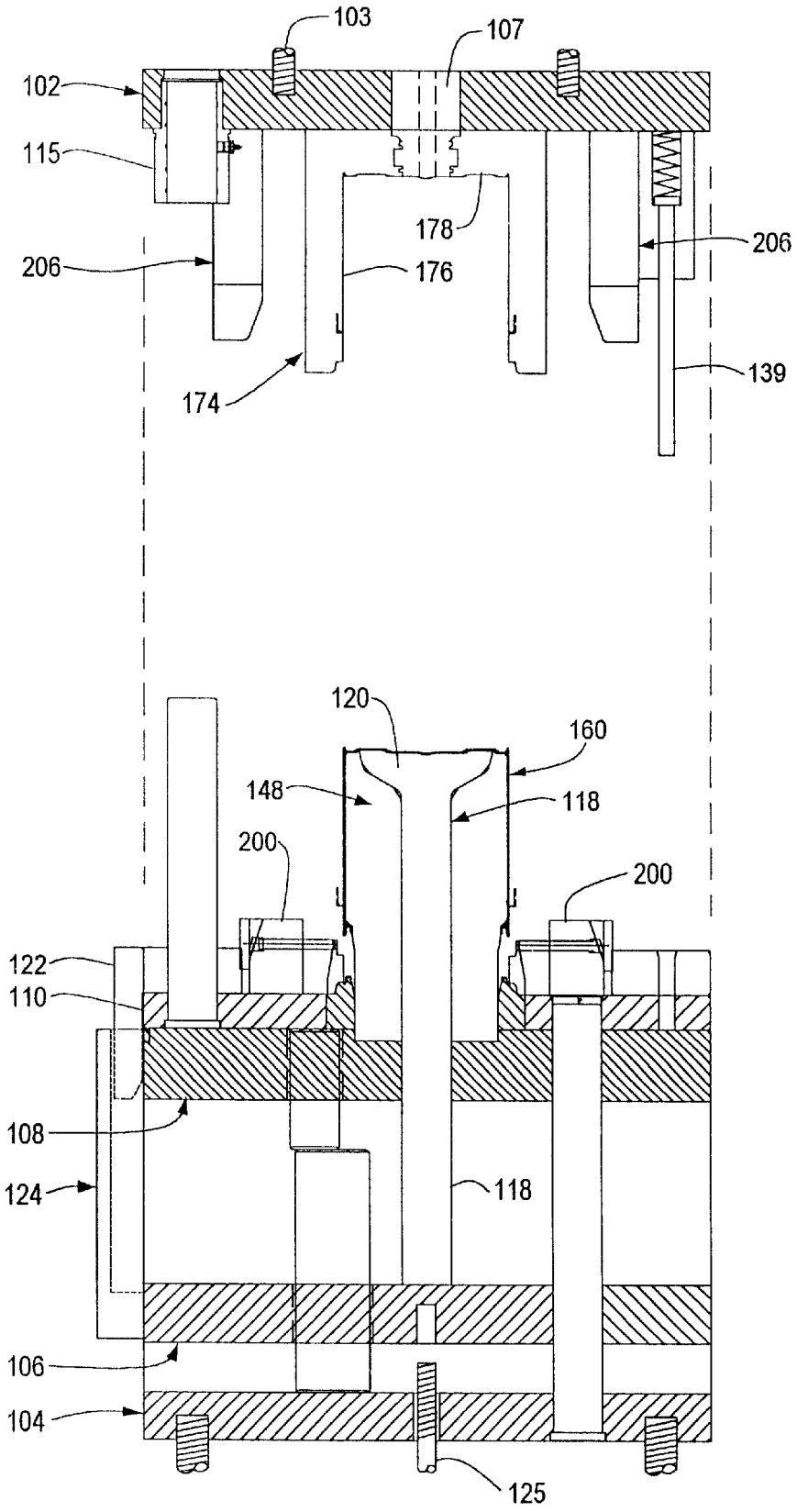
Figure 8B:
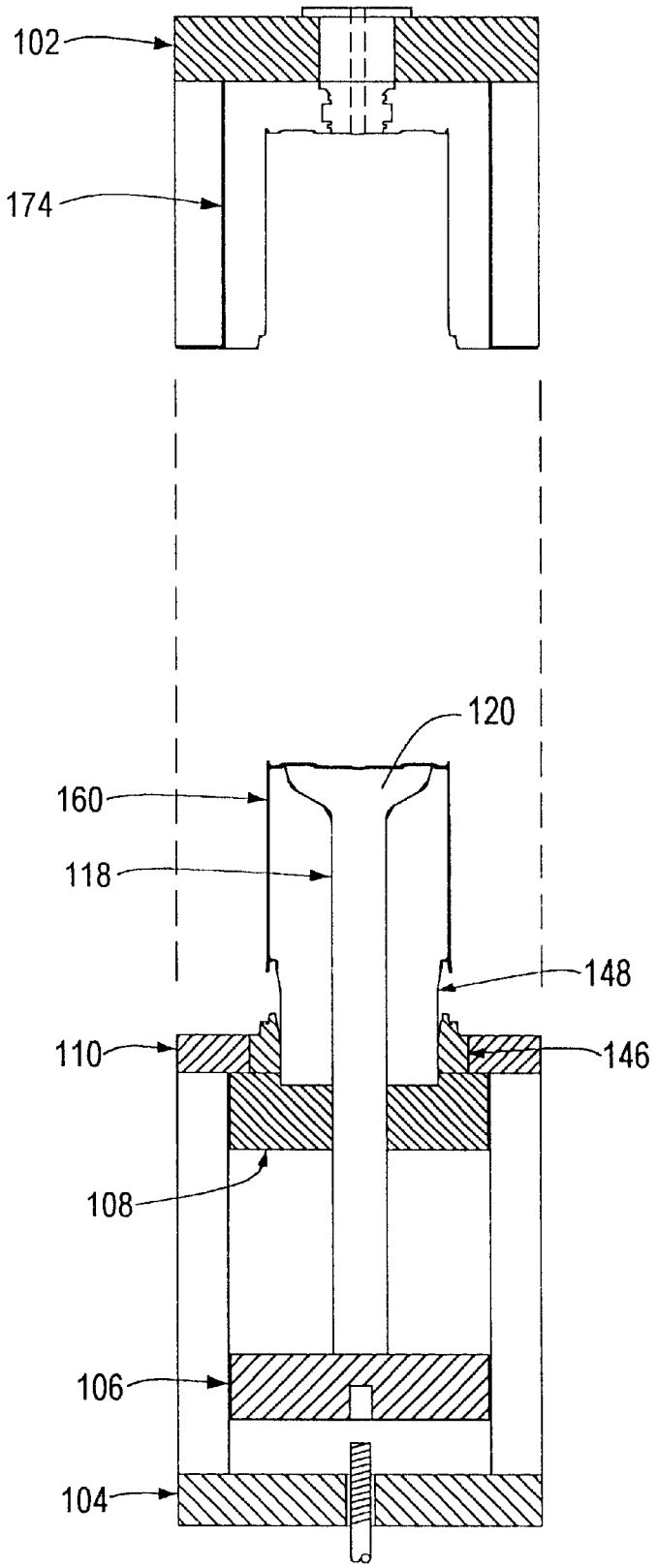

2. Immediately after the mold has been opened, the machine moves ejector plate 106 (and hence poppet 118) a selected distance away from back plate 4 (FIGS. 8A, 8B). By way of example but not limitation, this movement is about 2 inches in the case of molding a one gallon container for paint. During this movement, core plate 108 is locked to ejector 106 plate and hence it and core 148 move with the ejector plate. As seen in FIGS. 8A, 8B, this initial movement of ejector plate 106 moves core plate 108 into contact with or immediately adjacent to support plate 110. This joint movement of poppet 118 and core 148 is sufficient to strip the molded container free of ring member 146. It also is sufficient to move the rim portion of the formed container beyond the insert blocks 188, thereby allowing for lateral expansion of the formed container 160 as it is freed subsequently from core 148.

In this connection it should be noted that the wall-molding surface 164 of core member 148 has a larger diameter than its surfaces 166 and 168 which help mold the inner rim section 22 of the container. Accordingly the rim end of the formed container needs to expand outwardly as it is being forced off of the core member by relative movement of poppet 118 (see step 3 below). The molded container 160 has sufficient flexibility and resiliency to permit it to expand radially enough to fit over and slide along the core member under the driving influence of the poppet. In this connection it should be appreciated that this radial expansion could not occur without the prior limited movement of core member 148 by ejector plate 106, that limited movement being sufficient to move the formed container away from the ring member far enough to prevent the insert blocks 188 from restricting expansion of the rim section of the formed container as its rim section moves axially from the reduced diameter portion (surfaces 166 and 168) to the increased diameter portion (surface 164) of the core member.

Figure 9A:
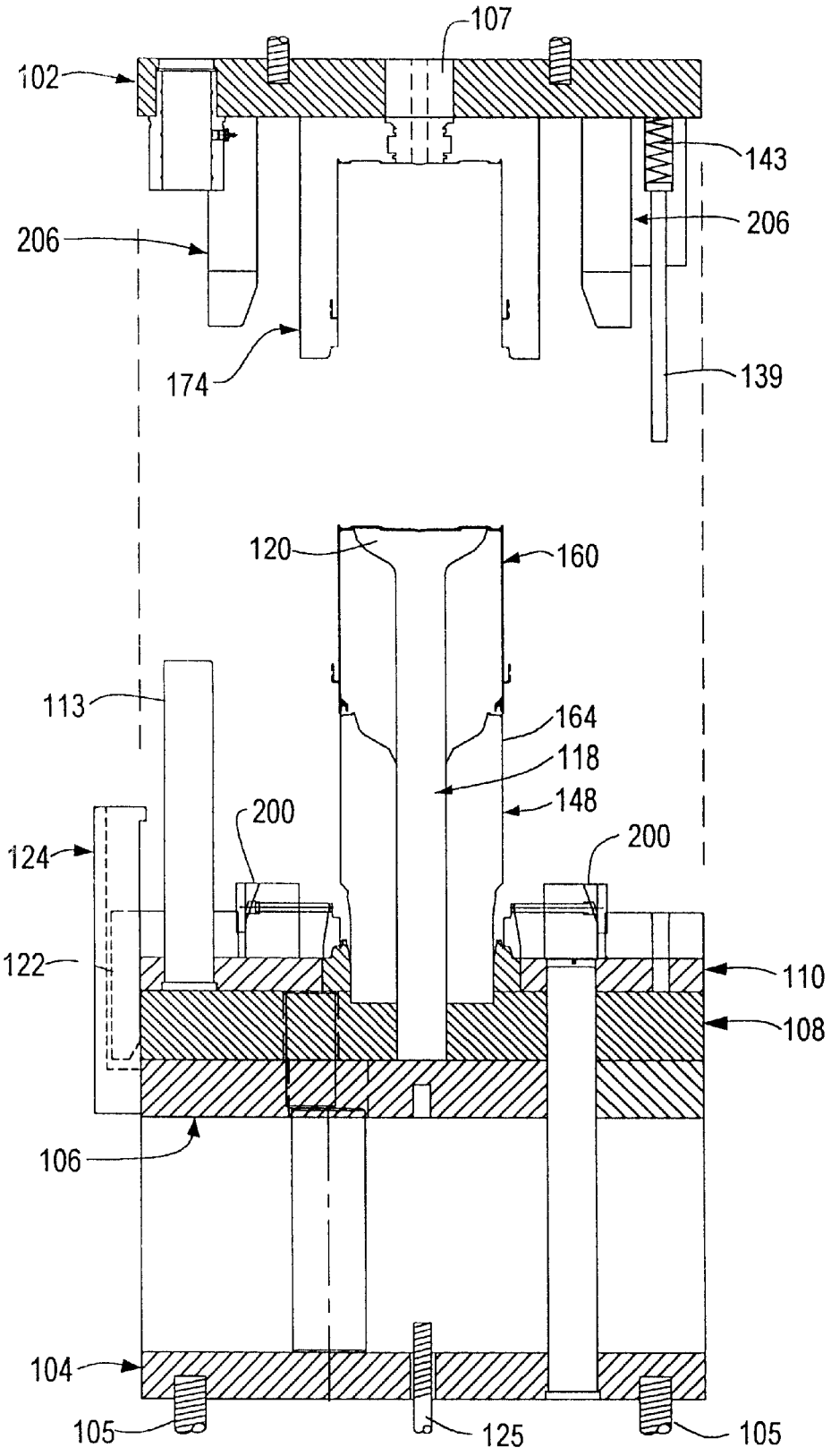
Figure 9B:
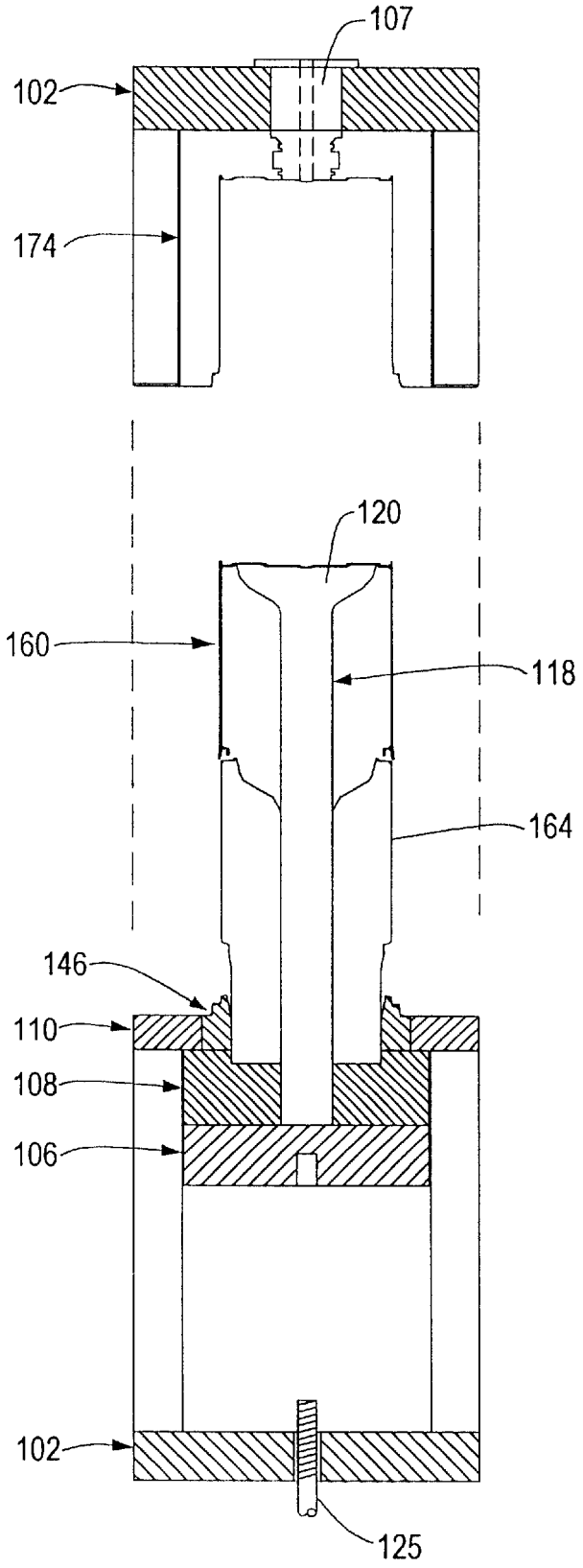

3. Thereafter, as core plate 108 engages support plate 110, cam bar 122 cams pin 132 inward of hole 134, thereby unlocking ejector plate 106 from core plate 108, and the machine continues to move the ejector plate further toward front plate 102. Preferably, as shown in FIGS. 9*a*, 9B, the machine moves ejector plate 106 into face-to-face contact or near face-to-face contact with core plate 108. This action achieves the result of moving the poppet relative to the core plate in a forward direction toward front plate 102, thereby forcing the formed container 160 off of core member 148.

4. Once the poppet has moved the formed container free of the core member, the container is removed from the poppet (FIGS. 10A, 10B). This may be done manually, in which case the machine is programmed to stop indefinitely to allow safe removal of the formed container, after which the machine can be commanded manually to resume its operating cycle. Preferably, however, the machine is provided with means (not shown) for automatically removing the formed container from the machine, with the machine being programmed to resume operation automatically immediately after removal of the molded container.

5. Following removal of the formed container, ejector plate 106 is retracted away from front plate 102 back to the position shown in FIGS. 8A, 8B. At the beginning of this retracting movement, core 148 remains stationary and latch bar 124 moves relative to cam bar 122 away from front plate 102. However, after the ejector plate has moved back a limited distance, e.g., about 6 inches, projection 130 of latch bar 124 engages the core plate at notch 132. Substantially simultaneously shoulder 140 moves past detent pin 132, whereupon spring 138 pushes that pin into slot 128. As a result, core plate 108 is again locked to the ejector plate.

6. Ejector plate 106 completes its rearward movement back to its original position (FIGS. 6A, 6B), carrying core plate 108 with it. As a result, when ejector plate 106 again rests against or adjacent to back plate 104, core plate 108 will be stopped by pillar 114 a limited distance from support plate 110, as shown in FIGS. 7A, 7B.

7. Thereafter back plate 104 and ejector plate 106 (and also core plate 108) are moved back toward front plate 102 far enough to cause core member 148 to mate with cavity member 174 (FIGS. 6A, 6B). As this occurs, cam bars 206 will re-engage core pins 196 and force them inward to molding position.

8. The cycle of operation is completed by again injecting molten plastic material into the formed cavity via sprue bushing 107. It is to be understood that the mold assembly stays in its closed position (FIGS. 6A, 6B) long enough to allow the injected molten plastic material to cool and solidify, after which the mold assembly is opened according to step (1) above.

Mold assemblies embodying the present invention may be provided for molding containers in sizes larger or smaller than the conventional one-gallon size commonly used by American paint manufacturers. Although the illustrated mold assembly was designed to mold containers with substantially straight side walls, it is contemplated that the cavity-defining components may be modified so as to provide for injection molding of containers that have a tapered side wall, with the containers having their maximum outer diameter at the top ends and their minimum outer diameter at their bottom ends. Also the mold assembly may be modified so as to eliminate formation of the strengthening rib 8, and/or to form other strengthening contours, recognizing that the need or desire for such feature may result from one or more factors or functions, e.g., container size, overall weight of the contents of the container, and the material of which the container is made. The mold assembly also may modified to vary the number of gripping ribs 36 on the rim section of the container. Also the mold assembly may be modified to totally eliminate formation of locking ribs 36, in which case the lid may be locked to the container rim solely as a result of the rib sections 70 and 80 being compressed together between and gripped by surfaces 32 and 40. Although it is preferred to make the containers and lids of a high density polyethylene, the mold assembly of the present invention may be used to injection mold containers of other plastics materials known to persons skilled in the art, e.g., polypropylene. Colored, clear or translucent plastic may be used in molding containers. The mold assembly also can be modified so as to mold the container with embossed printing on its side wall so as to eliminate the need for a subsequent labeling operation. The mold assembly also may be modified to mold containers having a rim section that is shaped differently from the rim section of the container shown in FIGS. 1–3. Still other changes will be obvious to persons skilled in the art from the foregoing description and the drawings.

The invention offers a number of advantages. Perhaps the most important advantage is that the invention provides a mold assembly for forming a container wherein the rim section extends inwardly of the inner surface of the container, and accomplishes this without having to use a collapsible core which is expensive to make and maintain. Another important advantage is that the invention makes it possible to manufacture a plastic container for use in holding paint or other products in liquid or particulate form that has sufficient strength to allow it to be filled, capped, labeled, and stacked or packaged using conventional filling, labeling and packaging machinery. Still other advantages provided by this invention are that the formed containers have a one-piece construction and, if desired, free of any seams or crimps.

What is claimed is:

1. A method of molding a container comprising the following steps:

(1) injecting a fluid thermoplastic polymeric material into a container-molding cavity formed by and between first and second non-expandable cavity members, a core member that extends through said second cavity member into said first cavity member, and an end surface of a poppet member that extends through an axial hole in said core member, said container-molding cavity being shaped for molding a container having an open top end with a grooved rim;

(2) after said injected material has solidified, separating said first cavity member from said second cavity member, said core member, and said end surface of said poppet member, with said plastic container remaining attached to said second cavity member, said core member and said end surface;

(3) moving said core member away from said second cavity member in the direction of said first cavity member a distance sufficient to free said plastic container from said second cavity member, with said plastic container remaining supported by said core member; and (4) moving said poppet member relative to said core member so as to remove said plastic container from said core member.

2. Method according to claim 1 further including the following step:

(5) removing said container from said poppet member.

3. Method according to claim 2 further including the following steps:

(6) removing said plastic container from said poppet member and moving it to a location remote from said cavity members and said core member;

(7) moving said first and second cavity members and said core member so as to re-establish said container-molding cavity; and (8) repeating steps (1) through (7).

4. Method according to claim 1 wherein in step (4) said poppet member moves axially toward said first cavity member.

5. A method of injection molding a plastic container adapted to be closed and sealed by a removable interlocking lid, said container comprising a bottom wall, a side wall formed integral with and extending upwardly from said bottom wall, and an open top, said side wall having a circular configuration in cross-section and having at its top end a bifurcated annular rim that comprises an outer rim section and an inner rim section that are joined to one another at their bottom ends, said outer rim section having an inner annular surface and said inner rim section being disposed inwardly of said side wall and having an outer annular surface that confronts said inner annular surface, said inner and outer annular surfaces being spaced from one another so as to define a channel therebetween for receiving a portion of an interlocking lid, said method comprising:

A. providing a mold assembly that comprises:

a first cavity member having cavity-defining surfaces that conform in shape to the exterior surfaces of said bottom wall and said side wall of said container;

a first plate supporting said first cavity member;

a second plate adapted to move toward and away from said first plate and said first cavity member;

a second cavity member carried by said second plate, said second cavity member being annular and having surfaces that are contoured so as to conform in shape to a portion of said outer rim section of said annular rim and a portion of said inner rim section of said annular rim;

a third plate adapted to move toward and away from said first plate, said second plate being disposed between said first and third plates;

a core member affixed to said third plate and extending through said second cavity member, said core member having a side surface with a circular cross-sectional configuration, a first portion of said side surface of core member conforming in shape and size to the interior surface of said side wall of said container and at least a portion of said bottom wall of said container, a second portion of said side surface of said core member conforming in shape and size to the inner rim portion of said annular rim, and a third portion of said side surface of said core member having a diameter smaller than said first portion of said outer surface;

a fourth plate adapted to move toward and away from said first plate;

a poppet member coupled to said fourth plate, said poppet member extending though an axially extending center hole in said core member and being movable relative to said core member, said poppet member having an end surface that conforms in shape to a portion of said end wall of said container;

said core member and said second cavity member being movable between a first closed position in which said first cavity member lies close to said second cavity member and surrounds said core member and cooperates with said core member and said second cavity member to define a mold cavity conforming in shape and size to said container and a second open position in which said first cavity member is spaced from said second cavity member by a distance in excess of the longitudinal dimension of said container; and a passageway for injecting a fluid polymeric material into said mold cavity;

B. positioning said core member and said second cavity member in said first closed position so as to form said mold cavity;

C. injecting a fluid polymeric material into said mold cavity so as to fill said mold cavity;

D. cooling said polymeric material so as to convert it to a solid plastic product conforming in shape to said container;

E. moving said core member and said second cavity member to said second open position so as to expose said solid plastic product with one end of said solid plastic product captivated by said core member and said second cavity member;

E. moving said core member and said poppet member relative to said second cavity member a limited distance sufficient to free said solid plastic product from said second cavity member;

F. moving said poppet member relative to said core member and said second cavity member toward said first plate a distance sufficient to move said solid plastic product free of said core member; and G. removing said solid plastic product from said poppet member and free of said mold assembly.

6. A mold assembly for molding a container having an open top end characterized by a rim that has an outer rim section and an inner rim section joined to one another so as to define therebetween an annular channel for receiving a locking rib of a lid for closing off said open top end, said mold assembly comprising:

an elongate core member having an axially-extending hole therein;

a first elongate cavity member having a cavity formed by internal surfaces thereof for receiving said core member;

a second annular cavity member surrounding said core member, said second cavity member being locked against movement in a radial direction relative to said core and said first cavity member;

an elongate poppet member extending through said hole in said core member, said poppet member being slidable axially relative to said core member;

said first and second cavity members being movable axially relative to one another between a first closed position in which said cavity members are in a close container-molding relation and a second open position in which said cavity members are spaced from one another by an amount sufficient to allow removal of a molded container;

said core member being movable axially relative to said second cavity member between a first container-molding position and a second container-releasing position;

said poppet member being movable axially relative to said core member between a first retracted position and a second extended position;

first means for (a) positioning said core member in its said first container molding position when said first and second cavity members are in their said first closed position, whereby said core member and said cavity members cooperate to define a mold cavity for molding a container, and (b) moving said core member to its said second container-releasing position when said first and second cavity members are in their said second open position;

second means for positioning said poppet member in its said first retracted position when said cavity members are in their said first closed position and said core member is in its said first container-molding position and for moving said poppet member to its said second extended position when said cavity members are in said their second open position and said core member is in its said second container-releasing position; and at least one passageway for injecting a polymeric fluid composition into said mold cavity.

7. A mold assembly according to claim 6 wherein said first and second cavity members and said core member have contoured surfaces that are in close proximity to one another when said cavity members are in their said first closed position and said core member is in its said first container-molding position, said contoured surfaces when in proximity to one another defining a mold cavity section that is shaped to form a grooved rim on said container.

8. A mold assembly according to claim 7 wherein said first cavity member includes first and second grooves for molding a pair of ears on said container, and further including auxiliary core members movable into and out of intersecting relation with said grooves for molding perforations in said ears.

9. A mold assembly according to claim 1 wherein said first cavity member is fixed against movement and said second cavity member and said core member are movable axially toward and away from said first cavity member.

10. A mold assembly according to claim 1 wherein said first cavity member is fixed against movement, and said second cavity member, said core member and said poppet member are movable as a unit toward and away from said first cavity member, and further including means coupling said first and second means for moving said core member and said poppet member in sequence toward and away from said first cavity member.

11. A mold assembly according to claim 6 wherein said second cavity member is shaped so that a container molded by injecting a plastic material into said mold cavity will have an annular rim with an annular channel defined by mutually confronting inner and outer annular side surfaces and a bottom surface that connects said inner and outer annular surfaces, with said channel having its greatest width adjacent where said bottom surface connects said mutually confronting inner and outer annular side surfaces.

12. A mold assembly according to claim 6 wherein said core member has a first portion with a relatively large diameter that extends into said cavity when said first and second cavity members are in said close container-molding relation and a second portion with a diameter smaller than said first portion, and further wherein said second annular cavity member is a solid ring characterized by an annular rib for molding said annular channel, said rib having an inside diameter smaller than the diameter of said first portion of said core member and larger than the diameter of said second portion of said core member, said ring surrounding said core member with said rib surrounding and having a fixed radial position relative to said second portion of said core member.

13. A mold assembly according to claim 6 wherein first and second cavity members are shaped so that the molded container has a side wall with a bottom end closed off by a bottom wall and an open top end characterized by a rim comprising concentric outer and inner rim sections having mutually confronting surfaces that define an annular groove therebetween, with said inner rim section and at least a substantial part of said groove extending inwardly of said side wall.

14. A mold assembly for injection molding a relatively straight-sided plastic container adapted to be closed and sealed by a removable interlocking lid, said container comprising a bottom wall, a side wall formed integral with and extending upwardly from said bottom wall, and an open top end that is characterized by an annular rim having an outer rim section and an inner rim section that are joined to one another so as to define an annular lid-locking channel therebetween, said mold assembly comprising:

a first cavity member having a cavity formed by internal surfaces that are shaped to conform to the exterior surfaces of said bottom wall and said side wall of said container and a portion of the outer rim section of said annular rim, said cavity member having an open end;

a second cavity member, said second cavity member being annular and being contoured so as to conform to the shape of another portion of said outer rim section of said annular rim, said channel and a portion of said inner rim section of said annular rim;

a core member for insertion into said first cavity member, said core member having an annular exterior end surface and an exterior side surface, said annular exterior end surface conforming in shape to a least a peripheral portion of said bottom wall of said container, a first portion of said exterior side surface conforming in shape to the interior surface of the side wall of said container, a second portion of said exterior side surface conforming in shape and size to a portion of the inner rim section of said annular rim, and a third portion of said exterior side surface having a diameter that is smaller than said second portion of said side surface; and an elongate poppet member, said poppet member extending though an axially extending center hole in said core member and being movable relative to said core member, said poppet member having an end surface that conforms in shape to a portion of the interior surface of said bottom wall of said container;

said first and second cavity members being mounted for movement toward and away from one another between a first closed position in which said first and second cavity members are adjacent to one another and a second open position in which said first cavity member is spaced from said second cavity member by a distance in excess of the longitudinal dimension of said container;

said core member being mounted for movement axially relative to said second cavity member, said core member being movable between a first molding position in which said second portion of its said exterior side surface is adjacent to said second cavity member and a second releasing position in which said second portion of its said exterior side surface is displaced from said second cavity member;

said poppet member being mounted for movement axially relative to said first and second cavity members between a first retracted position, a second intermediate position, and a third extended position; and means connecting said core member and said poppet member for (a) moving said core member from its said first molding position to its said second releasing position when said poppet member moves from said first retracted position to its said second intermediate position, and for holding said core member in said second position when said poppet member is moved to its said third extended position, and (b) for moving said core member from its said second releasing position back to its said molding position when said poppet member moves from its third extended position back to its said first retracted position via its said second intermediate position.

15. A mold assembly according to claim 14 wherein when (a) said first cavity member and said second cavity member are in their said first closed position, (b) said core member is in its said first molding position, and (c) said poppet member is in its said first retracted position, said poppet end surface and said annular end surface and said first portion of said side surface of said core member confront said internal surfaces of said first cavity member and cooperate therewith to define a first section of a mold cavity conforming in shape to the bottom and side walls of said container, and said second portion of said side surface of said core member is adjacent to said second cavity member and an adjacent surface portion of said first cavity member and cooperates therewith to define a second section of said mold cavity that communicates with said first mold cavity section and conforms in shape to said annular rim.

16. A mold assembly according to claim 14 wherein said first cavity member has a passageway for injecting a polymeric material into said mold cavity.

17. A mold assembly according to claim 15 further comprising:

a first plate supporting said first cavity member, a second plate movable toward and away from said first plate and said first cavity member;

a third plate disposed in a fixed spaced position relative to said second plate, said third plate being coupled to said second plate so as to be movable with said second plate toward and away from said first plate, said second cavity member being attached to said third plate;

a fourth plate disposed between said second plate and said third plate, said core member being attached to said fourth plate; and a fifth plate disposed between said fourth plate and said second plate and adapted to move toward and away from said first and second plates, said poppet member being attached to said fifth plate.

18. An injection mold assembly for molding a plastic container adapted to be closed and sealed by a removable interlocking lid, said container comprising a bottom wall, a tubular side wall formed integral with and extending upwardly from said bottom wall, and an open top, said side wall having at its top end an annular rim that comprises an outer rim section and an inner rim section that are joined to one another at their bottom ends, said outer rim section having an inner annular surface and said inner rim section being disposed inwardly of said side wall and having an outer annular surface that confronts said inner annular surface, said inner and outer annular surfaces being spaced from one another so as to define an annular channel therebetween for receiving a portion of an interlocking lid;

said assembly comprising:

a first cavity member (174) having a cavity formed by internal surfaces that are shaped to define and mold exterior surfaces of the bottom wall and side wall of a container;

a first plate (102) supporting said first cavity member;

a second plate (104), said second plate being movable toward and away from said first plate and said first cavity member;

a third plate (110) disposed in a fixed spaced position relative to said second plate, said third plate being coupled to said second plate so as to be movable with said second plate toward and away from said first plate;

a second cavity member (146) carried by said third plate, said second cavity member being annular and having surfaces that are shaped to define and mold a portion of said outer rim section of said annular rim for said container and a portion of said inner rim section of said annular rim;

a fourth plate (108) disposed between said second plate (104) and said third plate (110);

a core member (148) affixed to said fourth plate (108), said core member having an end surface that is remote from said fourth plate and confronts said first cavity member and a side surface with a circular cross-sectional configuration, said end surface being shaped to conform to and mold an annular peripheral portion of the interior surface of said bottom wall of said container, said side surface of said core member having first, second and third portions with said first portion being located nearest said first plate (102), said third portion of said core member being located nearest said fourth plate (108), and said second portion of said core member being located between said first and second portions thereof, said first portion of said side surface of said core member being shaped to conform to and mold the interior surface of said side wall of said container, said second portion of said side surface of said core member being shaped to conform to and mold an inner portion of said inner rim section of said annular rim, and said third portion of said side surface of said core member having a diameter smaller than said first and second portions of said side surface;

a fifth plate (106) disposed between said fourth plate (108) and said second plate (104) and adapted to move toward and away from said first and second plates;

a poppet member (118) attached to said fifth plate (106), said poppet member extending through said fourth plate and an axially extending center hole in said core member (148) and being movable with said fifth plate (106) relative to said core member (148);

said second and third plates (104, 110) being movable between a first open position in which said first cavity member is spaced from said second cavity member by a distance in excess of the longitudinal dimension of said container and a second closed position in which the said surfaces of said second cavity member lie close to portions of said first cavity member;

said fourth and fifth plates (108, 106) being movable relative to said second plate (104) when said second and third plates are in said second closed position between (a) a core member first position in which (1) said end surface and said first portion of said side surface of said core member confront internal surfaces of said first cavity member and cooperate therewith to define a first mold cavity section conforming in shape to the bottom and side walls of said container, and (2) said second portion of said side surface of said core member is adjacent to said second cavity member and an adjacent surface portion of said first cavity member and cooperates therewith to define a mold cavity section that communicates with said first mold cavity section and conforms in shape to said annular rim; and (b) a core member second position in which said second portion of said core member is displaced from said second cavity member in the direction of said first plate;

said fifth plate (106) being movable relative to said second and fourth plates in the direction of said first plate a distance at least equal to the longitudinal dimension of said container when said second and third plates are in said first open position; and a passageway for injecting a fluid polymeric material into said first mold cavity section.

19. An injection mold assembly according to claim 18 wherein said second mold cavity section is shaped so that a container molded by injecting a plastic material into said first and second mold cavity sections will have an annular rim having a channel defined by inner and outer annular surfaces that has its greatest width adjacent where said inner and outer annular surfaces are joined.

20. An injection mold assembly according to claim 18 further including releasable means for locking together said fourth and fifth plates until said fourth plate is in a predetermined position relative to said first plate.

21. An injection mold assembly according to claim 20 wherein said releasable means comprises a cam member (222) attached to said third plate (110) and a latch means (124, 132) carried by said fifth plate.

22. An injection mold assembly for manufacturing a plastic container adapted to be closed and sealed by a removable interlocking lid, said container comprising a bottom wall, a side wall formed integral with and extending upwardly from said bottom wall, and an open top, said side wall having a circular configuration in cross-section and having at its top end a bifurcated annular rim that comprises an outer rim section and an inner rim section that are joined to one another at their bottom ends, said outer rim section having an inner annular surface and said inner rim section being disposed inwardly of said side wall and having an outer annular surface that confronts said inner annular surface, said inner and outer annular surfaces being spaced from one another so as to define a channel therebetween for receiving a portion of an interlocking lid;

said assembly comprising:

a first cavity member (174) contoured to define a cavity conforming in shape to the exterior of said bottom wall and said side wall of said container;

a first plate (102) supporting said first cavity member;

a second plate (104) adapted to move toward and away from said first plate and said first cavity member;

a third plate (110) disposed in a fixed spaced position relative to said second plate, said third plate being coupled to said second plate so as to be movable with said second plate toward and away from said first plate;

a second cavity member (146) carried by said third plate, said second cavity member being annular and being contoured to define an annular cavity conforming in shape to said outer rim section of said annular rim and a portion of said inner rim section of said annular rim;

a fourth plate (108) disposed between said second plate and said third plate and adapted to move toward and away from said first plate;

a core member (148) affixed to said fourth plate, said core member comprising a first section having (a) an end surface that is spaced from said fourth plate in confronting relation with said first cavity member, and (b) a side surface that conforms in shape and size to the interior surfaces of said bottom wall and said side wall of said container, a second section having a side surface that conforms in shape and size to the inner rim portion of said annular rim, and a third section having a side surface with a circular cross-sectional configuration and a diameter that is smaller than the side surface of said first section of said core member; surface;

a fifth plate (106) disposed between said fourth plate and said second plate and adapted to move toward and away from said first plate;

a poppet member (118) coupled to said fifth plate, said poppet member extending though an axially extending center hole in said core member, said poppet member being movable axially relative to said core member;

said second and third plates being movable between a first open position in which said first cavity member is spaced from said second cavity member by a distance in excess of the longitudinal dimension of said container and a second closed position in which said first cavity member lies close to said second cavity member; and said fourth and fifth plates being movable when said second and third plates are in said second closed position from a core member first position in which a first portion of said core member confronts said first cavity member and cooperates therewith to define a first mold cavity section conforming in shape to the bottom and side walls of said container, and a second portion of said core member is adjacent to said second cavity member and an adjacent surface portion of said first cavity member and cooperates therewith to define a second mold cavity section that communicates with said first mold cavity section and conforms in shape to said annular rim.

23. A mold assembly according to claim 22 wherein said first and second cavity members are shaped so as to mold a plastic container that has outer and inner rim sections with the outer rim section extending further than the inner rim section from the bottom wall of the container.

24. A mold assembly according to claim 22 wherein at least one of said first and second cavity members is shaped so as to form one or more locking projections on at least one of the outer and inner rim sections of the molded container.

25. A mold assembly according to claim 22 wherein first and second cavity members are shaped so that the molded container has outer and inner rim sections, with first and second rim sections having mutually confronting surfaces that define an annular groove, said mutually confronting surfaces being inclined to the central longitudinal axis of said container.

26. A mold assembly for injection molding a relatively straight-sided plastic container adapted to be closed and sealed by a removable interlocking lid, said container comprising a bottom wall, a side wall formed integral with and extending upwardly from said bottom wall, and an open top end that is characterized by an annular rim having an outer rim section and an inner rim section that are joined to one another so as to define an annular locking channel therebetween for receiving and interlocking with a peripheral portion of said lid, said assembly comprising:

a first cavity member having first and second internal surfaces that are shaped to define and mold the exterior surfaces of the bottom wall and the side wall respectively of said container;

a first plate supporting said first cavity member;

a second plate adapted to move toward and away from said first plate and said first cavity member;

a third plate disposed in a fixed spaced position relative to said second plate, said third plate being coupled to said second plate so as to be movable with said second plate toward and away from said first plate;

a second cavity member carried by said third plate, said second cavity member being annular and having surfaces that are shaped to define and mold selected surfaces of a portion of an outer rim section and a portion of an inner rim section of said container;

a fourth plate disposed between said second plate and said third plate and adapted to move toward and away from said first plate;

a core member affixed to said fourth plate, said core member having an annular end surface that is shaped to define and mold a peripheral portion of the inner surface of the bottom wall of the container and a side surface that has a circular cross-sectional configuration, a first portion of said side surface being shaped to define and mold the interior surface of the side wall of said container, and a second portion of said side surface being shaped to define and mold an interior portion of an inner rim section of said container;

a fifth plate disposed between said fourth plate and said second plate and adapted to move toward and away from said first plate;

a poppet member coupled to said fifth plate, said poppet member extending though an axially extending center hole in said core member and being movable with said fifth plate relative to said core member and said fourth plate, said poppet member having an end surface that is shaped to define and mold a portion of the interior surface of said bottom wall of said container;

said second and third plates being movable between a first open position in which said first cavity member is spaced from said second cavity member by a distance substantially in excess of the longitudinal dimension of said container and a second closed position in which said first cavity member surrounds said core member and cooperates with said core member and said second cavity member to define a mold cavity for molding said container;

said fourth and fifth plates being movable when said second and third plates are in said second closed position from (a) a core member first position in which (1) said annular end surface and said first portion of side surface of said core member confront said first cavity member and cooperate therewith to define a first section of said mold cavity conforming in shape to the bottom and side walls of said container, and (2) said second portion of said side surface of said core member is adjacent to said second cavity member and an adjacent surface portion of said first cavity member and cooperates to define a second section of said mold cavity that communicates with said first mold cavity section and conforms in shape to said inner and outer rim sections; and (b) a core member second position in which said second portion of said core member is spaced from said second cavity member;

said fifth plate being movable relative to said second, third and fourth plates in the direction of said first plate a distance at least equal to the maximum longitudinal dimension of said container when said second and third plates are in said first open position and said fourth and fifth plates are in said second core member position; and a passageway for injecting a polymeric material into said mold cavity.

27. A mold assembly according to claim 26 wherein said passageway extends through said first plate and a portion of said first cavity member.

28. A mold assembly for molding a container having an open top characterized by a rim that is shaped to make an interlocking connection with a complementary lid, said mold assembly comprising:

a first cavity member having an annular configuration characterized by a central opening;

a second annular cavity member characterized by a central opening, said second cavity member being locked against movement in a radial direction relative to said first cavity member;

said first and second cavity members being movable axially relative to one another between a first open position in which said cavity members are spaced from one another by an amount in excess of the longitudinal dimension of said container and a second closed position in which said first and second cavity members are in a close container-molding relation;

a core member having a central opening, an end surface confronting said second cavity member, and an exterior side surface, said core member extending through said central opening of said second cavity member and being movable axially relative to said first cavity member between a first core member position in which said core member extends into said central opening of said first cavity member and said end surface of said core member lies immediately adjacent to but is spaced a first predetermined distance from said first cavity member and a second core member position in which said end surface of said core member is spaced a second predetermined distance from said first cavity member, said second predetermined distance exceeding said first predetermined distance; and a poppet member, said poppet member extending through said central opening of said core member toward said second cavity member; said poppet member having an end surface, said poppet member being movable reciprocally from one to another of three predetermined positions relative to said first cavity member, the first one of said three predetermined position being a retracted position in which said end surface of said poppet member is coincident with said end surface of said core member when said core member is in said first core member position, the second one of said three predetermined positions being an intermediate position in which said poppet member is coincident with said end surface of said core member when said core member is in said second core member position, and the third one of said three predetermined positions being an extended position in which said poppet member has been advanced relative to said core member further toward said second cavity member by an amount exceeding the longitudinal dimension of the container.

29. A mold assembly for molding a container having an open top end characterized by a rim that has an outer rim section and an inner rim section joined to one another so as to define therebetween an annular channel for receiving a locking rib of a lid for closing off said open top end, said mold assembly comprising:

an elongate core member having an axially-extending hole therein;

a first elongate cavity member having a cavity formed by internal surfaces thereof for receiving said core member;

a second cavity member in the form of solid ring surrounding said core member, said second cavity member being locked against movement in a radial direction relative to said core and said first cavity member and having an annular rib projecting toward said first cavity member that is shaped to mold said annular channel;

an elongate poppet member extending through said hole in said core member, said poppet member being slidable axially relative to said core member;

said second cavity member being movable with said core member axially relative to said first cavity member between a first position in which said cavity members and said core member are in a close container-molding relation and a second position in which said second cavity member and said core member are spaced from said first cavity member by an amount sufficient to allow removal of a molded container;

said core member being movable axially relative to said second cavity member;

first means for moving said core member axially relative to said second cavity member so as to locate said core member (a) in a container-molding position adjacent said annular rib of said second cavity member and (b) in a container-releasing position spaced from said annular rib of said second cavity member;

said poppet member being movable axially relative to said core member between a first retracted position and a second extended position;

means for moving said poppet member so as to position said poppet member (a) in its said first retracted position when said cavity members and said core member are in said first position and (b) in its said second extended position when said cavity members and said core member are in said second position and said core member is in said container-releasing position relative to said annular rib of said second cavity member; and at least one passageway for injecting a polymeric fluid composition into said mold cavity.

30. A mold assembly according to claim 29 wherein said first cavity member includes first and second grooves for molding a pair of ears on said container, and further including auxiliary core members movable into and out of intersecting relation with said grooves for molding perforations in said ears, said auxiliary core members being fixed relative to said second cavity member.

31. A mold assembly according to claim 29 wherein said first and second cavity members and said core member are shaped so that a container molded by injecting a plastic material into said mold cavity will have a side wall and a rim at its top end characterized by outer and inner rim sections defining an annular channel therebetween, with said inner rim section having outer and inner diameters that are less than the inner diameter of said side wall and at least a substantial part of said annular channel being disposed inwardly of said side wall.

* * * * *

UNITED STATES PATENT AND TRADEMARK OFFICE

CERTIFICATE OF CORRECTION

PATENT NO. : 6,245,277 B1
DATED : June 12, 2001
INVENTOR(S) : David W. Diamond

It is certified that error appears in the above-identified patent and that said Letters Patent is hereby corrected as shown below:

Column 14, claim 6,
Lines 27 and 28, "said their" should be -- their said --;

Column 14, claim 9,
Line 46, "1" should be -- 6 --;

Column 14, claim 10,
Line 50, "1" should be -- 6 --;

Column 19, claim 22,
Line 26, delete "surface";

Column 21, claim 26,
Line 1, insert "said" before -- side --;

Column 22, claim 28,
Line 2, "position" should be -- positions --; and

Column 22, claim 29,
Line 28, insert "a" before -- solid ring --.

Signed and Sealed this

Fifteenth Day of January, 2002

*Attest:*

*Attesting Officer*

JAMES E. ROGAN
*Director of the United States Patent and Trademark Office*